US008998379B2

(12) United States Patent
Ohnishi et al.

(10) Patent No.: US 8,998,379 B2
(45) Date of Patent: Apr. 7, 2015

(54) IMAGE FORMING APPARATUS

(75) Inventors: Masashi Ohnishi, Kanagawa (JP); Junji Seto, Kanagawa (JP); Tsutomu Sasaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 46 days.

(21) Appl. No.: 12/486,109

(22) Filed: Jun. 17, 2009

(65) Prior Publication Data

US 2009/0315943 A1 Dec. 24, 2009

(30) Foreign Application Priority Data

Jun. 19, 2008 (JP) ..... 2008-160735

(51) Int. Cl.
*B41J 2/165* (2006.01)
*B41J 2/17* (2006.01)

(52) U.S. Cl.
CPC ..... *B41J 2/16523* (2013.01); *B41J 2/1721* (2013.01); *B41J 2002/1728* (2013.01)

(58) Field of Classification Search
None
See application file for complete search history.

(56) References Cited

U.S. PATENT DOCUMENTS

| | | | | |
|---|---|---|---|---|
| 5,818,482 | A | 10/1998 | Ohta et al. | |
| 2007/0030302 | A1* | 2/2007 | Yamada | 347/31 |
| 2007/0030304 | A1 | 2/2007 | Yamada | |
| 2007/0273725 | A1* | 11/2007 | Furukawa et al. | 347/36 |
| 2008/0158294 | A1* | 7/2008 | Katoh | 347/36 |
| 2009/0219338 | A1* | 9/2009 | Harada | 347/36 |

FOREIGN PATENT DOCUMENTS

| | | |
|---|---|---|
| JP | 1-165446 | 6/1989 |
| JP | 1-299044 | 12/1989 |
| JP | 4-44860 | 2/1992 |
| JP | 11-157099 | 6/1999 |
| JP | 2001-162829 | 6/2001 |
| JP | 2002-29065 | 1/2002 |
| JP | 2002-86759 | 3/2002 |
| JP | 2003-11394 | 1/2003 |
| JP | 2003-54009 | 2/2003 |
| JP | 2003-285452 | 10/2003 |
| JP | 2004-98475 | 4/2004 |
| JP | 2005-119210 | 5/2005 |

(Continued)

OTHER PUBLICATIONS

Japanese official action dated Nov. 13, 2012 in connection with corresponding Japanese patent application No. 2008-160735.
Jun. 26, 2012 Japanese office action of the Japanese Patent Office in connection with a corresponding Japanese patent application.

(Continued)

*Primary Examiner* — Alejandro Valencia
(74) *Attorney, Agent, or Firm* — Cooper & Dunham LLP

(57) ABSTRACT

An image forming apparatus prevents the problem of reduced utilization efficiency of a waste fluid tank caused by the storage of waste fluids with high and low viscosities in the same open-type waste fluid tank. The image forming apparatus includes a first waste fluid tank for storing waste ink fluid ejected from a recording head, and a second waste fluid tank for storing waste ink fluid ejected into a cap of the recording head. The waste ink fluid ejected into the cap is guided to the second waste fluid tank via a tube. The second waste fluid tank is an airtight structure having an inlet at one end to which the tube is detachably connected via a needle or a valve. At the other end of the second waste fluid tank, there is disposed an opening communicating the inside and the outside of the tank.

7 Claims, 31 Drawing Sheets

(56) References Cited

FOREIGN PATENT DOCUMENTS

| | | |
|---|---|---|
| JP | 2005-199526 | 7/2005 |
| JP | 2006-256136 | 9/2006 |
| JP | 2007-38590 | 2/2007 |
| JP | 2007-76339 | 3/2007 |
| JP | 2007-253471 | 10/2007 |

OTHER PUBLICATIONS

Japanese official action dated Sep. 4, 2012 in connection with corresponding Japanese patent application No. 2008-160735.

Japanese official action dated May 7, 2013 in connection with corresponding Japanese patent application No. 2008-160735.

Japanese official action dated Mar. 12, 2013 in connection with corresponding Japanese patent application No. 2008-160735.

* cited by examiner

IMAGE FORMING APPARATUS

BACKGROUND

1. Technical Field

This disclosure generally relates to image forming apparatuses, and particularly to the structure of a waste fluid tank in an image forming apparatus.

2. Description of the Related Art

As an example of image forming apparatuses, which include printers, facsimile machines, copiers, plotters, and multifunction peripherals, an inkjet recording apparatus is known that employs a recording head configured to eject droplets of ink. The recording head ejects the ink droplets via a nozzle onto a recording medium, such as a sheet of paper, in order to form (i.e., record, print, transfer, etc.) an image thereon as the recording medium is transported.

The inkjet recording apparatus comes in two types. One is the serial type in which the recording head is moved in a main scan direction as it ejects ink droplets. The other is the line type in which the recording head does not move when it ejects ink droplets.

The term "recording medium" on which the image is formed is herein intended to refer to not only a sheet of paper but also various media of various materials on which ink droplets can be landed to form a desired image. Thus, the "recording medium" includes sheets of threads, fibers, cloth, fabrics, leather, metals, plastics, glass, wood, and ceramics, for example. To "form an image" is herein intended to refer to not only the imparting of an image with some meaning, such as letters or figures, onto a recording medium but also the imparting of an image without any apparent meaning, such as random patterns, onto the medium (by simply landing ink droplets onto the medium). The term "ink" is intended to refer to not only what is generally called "ink" but also any fluid with which an image can be formed on the recording medium. Such fluid may therefore be referred to as "recording fluid" or "fixing solution".

The structure of the recording head in an inkjet recording apparatus gives rise to several inherent problems. For example, the ink viscosity increases and the ink may even solidify if a solvent component of the ink evaporates out of the nozzle. An ejection defect or a recording failure may be caused by the accumulation of dust or grime on the nozzle or by the entry of air bubbles into the nozzle. Thus, the inkjet recording apparatus is normally equipped with a maintenance/recovery mechanism for maintaining or recovering the intended performance of the recording head.

For example, the maintain/restore mechanism includes a cap (which may be also referred to as a "capping unit" or a "cap member"). When the apparatus is not being used, the recording head is sealed with the cap in order to prevent the drying or increase in viscosity of the ink within the nozzle. In another example, ink droplets that do not contribute to the recording operation are ejected before, after, and/or during the recording operation, so that the ink with increased viscosity within the nozzle can be ejected in order to recover or maintain the ejection performance of the nozzle.

Such ejection of ink droplets not contributing to image formation but that is performed for maintaining nozzle performance may be referred to as a "preliminary ejection" or "blank ejection". During the blank ejection, the ink droplets are ejected into a dedicated blank ejection receptacle or the cap.

An example of the waste fluid tank (which may also be referred to as a "waste fluid container", or a "waste fluid reservoir unit) for collecting the waste ink fluid produced by the recording head maintenance/recovery operation is disclosed in Japanese Laid-Open Patent Application No. 2005-119210. In this example, the waste ink fluid sucked out of the head into the cap and the ink blank ejected into a receptacle are collected in the same waste fluid tank.

Japanese Laid-Open Patent Application No. 2007-253471 discloses another example of the waste fluid tank. The waste fluid tank includes a waste fluid inlet and an atmosphere communicating hole, wherein an absorbing body for absorbing the waste fluid is disposed between the waste fluid inlet and the atmosphere communicating hole. In yet another example disclosed in Japanese Laid-Open Patent Application No. 2003-285452, the waste fluid tank also includes an absorbing body.

Japanese Laid-Open Patent Application No. 2001-162829 discloses yet another example of the waste fluid tank consisting of a fixed waste fluid reservoir unit and a detachable waste fluid reservoir unit. Furthermore, Japanese Laid-Open Patent Application No. 2007-76339 discloses an arrangement for detecting a filled-up state of the waste fluid tank, wherein a fill-up detecting absorbing body is installed on the side of an opening for the entry of waste fluid.

Japanese Laid-Open Patent Application No. 2005-199526 discloses a waste fluid tank of hermetically sealed structure, wherein the inside of the tank is opened to the atmosphere when the waste fluid is introduced into the waste fluid tank.

The aforementioned image forming apparatuses and their waste fluid tanks are disadvantageous in the following respects.

When a waste fluid of a quick-drying ink, such as a pigment-based ink, is collected in a waste fluid tank, the waste fluid increases in viscosity upon contact with air and produces a deposit of ink. The waste fluid may also dry after it is absorbed in the absorption member, thereby blocking the absorption of subsequent waste fluid.

There are the two kinds of waste fluid that is produced as a result of the maintenance/recovery operation. One is the waste fluid that accumulates in the cap into which the ink is ejected by the recording head. The other is the waste ink that collects in the blank ejection receptacle member into which the ink is ejected from the recording head. When the waste fluids from these two sources are collected in the same waste fluid tank, the utilization efficiency of the waste fluid tank decreases as the waste fluids turn into a deposit as mentioned above.

In order to control the drying of the waste fluid, the waste fluid tank may be air-tightly structured. However, in this case, an opening must be provided to the tank in order to release air out of the tank into the atmosphere, for example, so that the waste fluid can be introduced into the waste fluid tank.

When a fill-up detecting unit is installed in an airtight waste fluid tank for detecting the filled-up state, there is the problem that, if the fill-up detecting unit is installed nearer to the waste fluid introducing position than the atmosphere opening, the filled-up state is detected before the waste fluid reaches a level up to which the waste fluid tank should be capable of holding the waste fluid, thus lowering the utilization efficiency of the waste fluid tank.

On the other hand, in the case of a non-airtight waste fluid tank having an opening portion for the entry of waste fluid, the collected waste fluid leaks out of the opening portion when the image forming apparatus and hence the waste fluid tank are tilted.

BRIEF SUMMARY

In an aspect of this disclosure, there is provided an image forming apparatus including a recording head having a nozzle for ejecting a droplet of ink; a cap for capping the nozzle of the recording head; a first waste fluid tank configured to store a waste ink fluid received in a blank ejection receptacle; a second waste fluid tank configured to store the waste ink fluid ejected by the recording head into the cap; and a tube member connected between the cap and the second waste fluid tank to guide the waste ink fluid in the cap to the second waste fluid tank.

The second waste fluid tank has an airtight structure and includes a waste fluid inlet portion at one end along a longitudinal direction thereof, to which waste fluid inlet portion is detachably connected a waste fluid discharged-end of the tube member. The second waste fluid tank further includes a communicating opening in an upper surface at the other end of the tank, providing communication between the inside and the outside of the tank.

BRIEF DESCRIPTION OF THE DRAWINGS

The aforementioned and other aspects, features and advantages will be apparent to those skilled in the art from the following detailed description of the invention, when read in conjunction with the accompanying drawings in which.

DETAILED DESCRIPTION OF THE PREFERRED EMBODIMENTS

Figure 1:
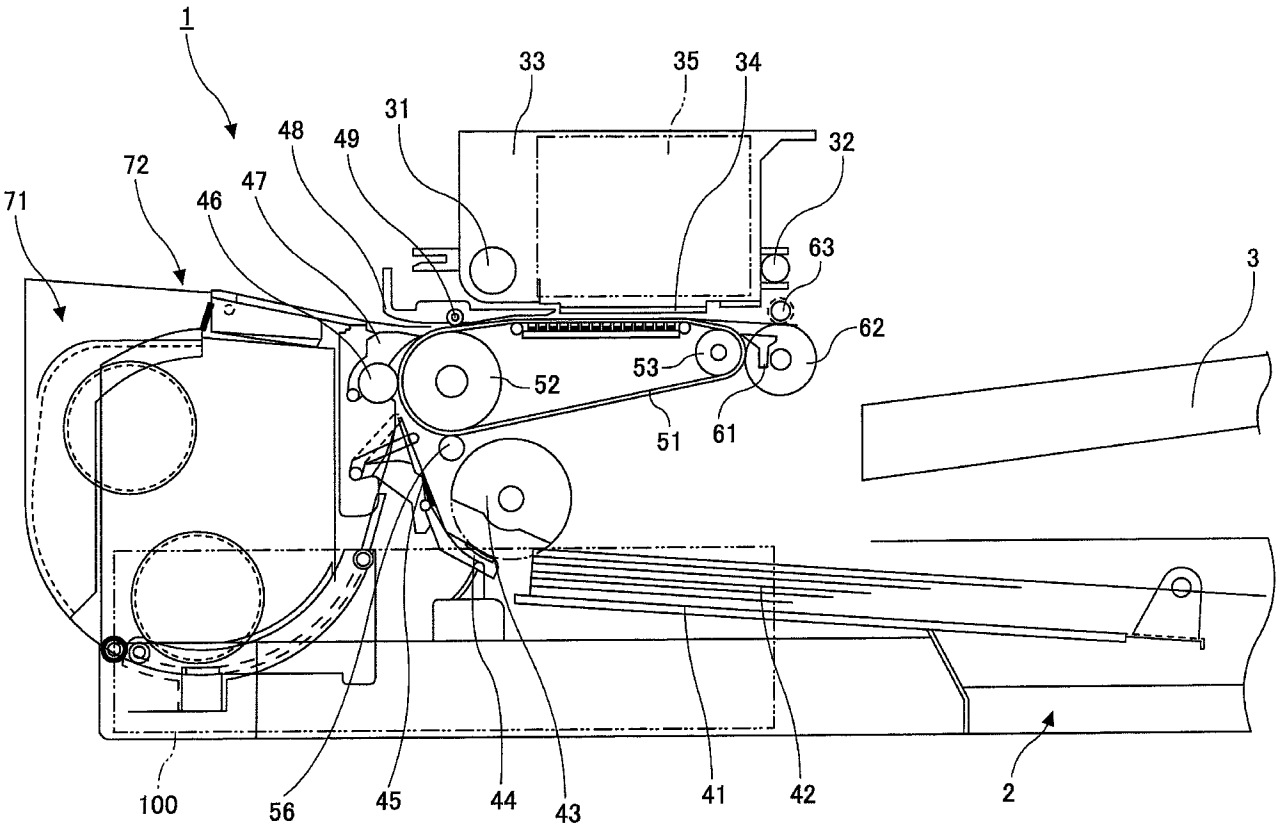
FIG. 1 shows the mechanical structure of part of an image forming apparatus according to an embodiment of the present invention.

In the following, embodiments of the present invention are described with reference to the attached drawings, wherein like reference numerals designate identical or corresponding parts throughout the several views.

Figure 2:
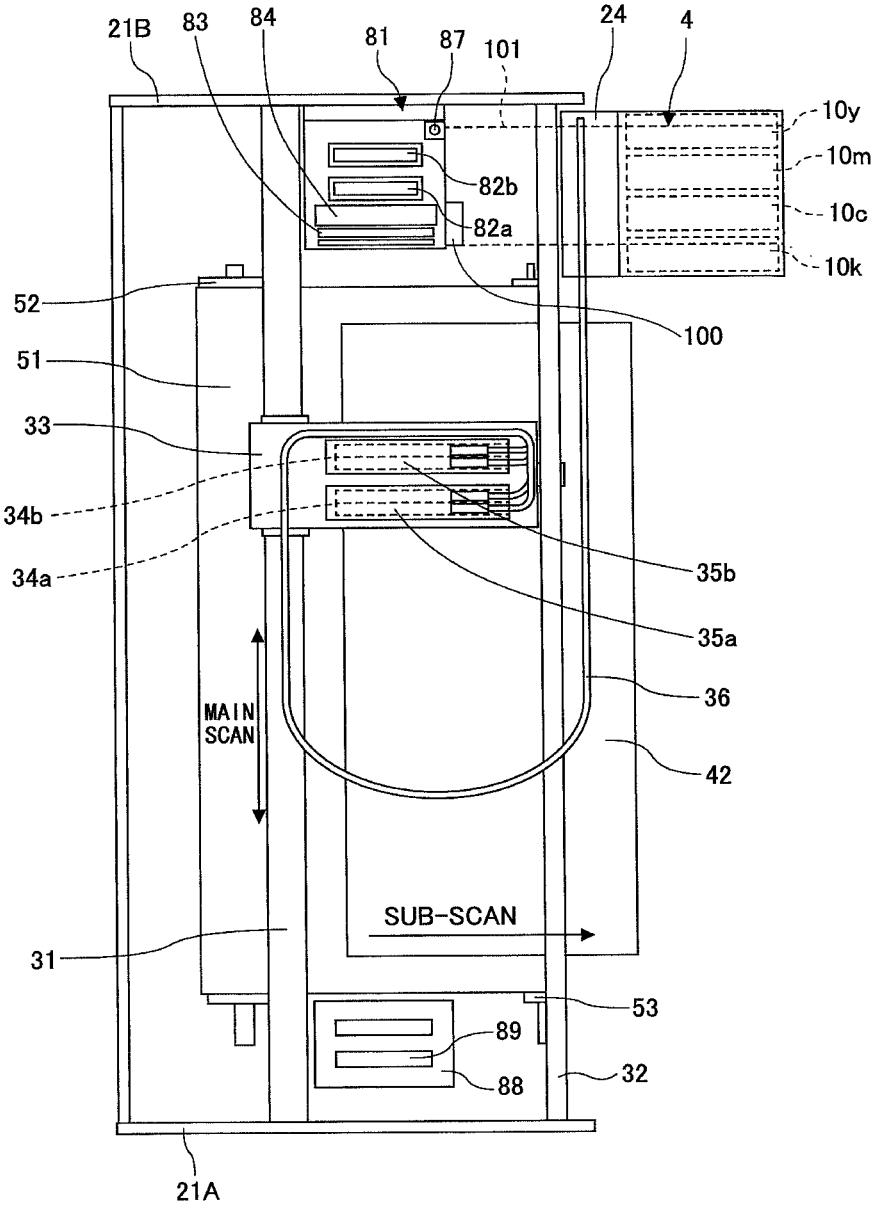
FIG. 2 is a plan view of main components of the mechanical structure.

First, turning to FIGS. 1 and 2, a serial-type inkjet recording apparatus to which the present invention is directed is described. FIG. 1 shows a side view of a main, mechanical portion of the inkjet recording apparatus. FIG. 2 shows a plan view of the main portion of the apparatus. As shown in FIG. 1, the serial-type inkjet recording apparatus includes an apparatus main body 1. The apparatus main body 1 includes side plates 21A and 21B. Between the side plates 21A and 21B, guide rods 31 and 32 are extended as guide members. The guide rods 31 and 32 support a carriage 33 slidably in a main scan direction indicated by a vertical arrow in FIG. 2. The carriage 33 is moved in the main scan direction by a main scan motor (not shown) via a timing belt.

The carriage 33 carries recording heads 34*a* and 34*b* (which may be collectively referred to as a recording head 34) including individual fluid ejection heads (not shown) for discharging ink droplets of the individual colors of yellow (Y), cyan (C), magenta (M), and black (K). Lines of nozzles for the individual heads are disposed in a sub-scan direction perpendicular to the main scan direction, the nozzles being directed downward.

Each of the recording heads 34*a* and 34*b* has two lines of nozzles. On the recording head 34*a*, one line of nozzles may eject black (K) ink droplets while the other line of nozzles may eject cyan (C) droplets. On the recording head 34*b*, one line of nozzles may eject magenta (M) droplets while the other line of nozzles may eject yellow (Y) droplets.

The carriage 33 also carries sub-tanks 35*a* and 35*b* (which may be referred to collectively as a sub-tank 35) for supplying ink of the respective colors corresponding to the lines of nozzles of the recording head 34. The sub-tank 35 is supplied with the individual colors of ink from ink cartridges 10*y*, 10*m*, 10*c*, and 10*k* (which may be collectively referred to as an ink cartridge 10) that are detachably mounted on a cartridge loading unit 4, via a supply tube 36 for each color by a supply pump unit 5.

The apparatus main body 1 of the inkjet recording apparatus includes a sheet-feed tray 2 having a sheet mount portion (pressure plate) 41. On the sheet mount portion 41, there are placed sheets 42 of recording medium which are fed out from the sheet mount portion 41 one by one by a sheet feeding unit including a half-moon roller 43 and a separating pad 44 disposed opposite the half-moon roller 43. The separating pad 44 is made from a material with a large coefficient of friction, and is biased toward the half-moon roller 43.

The sheet 42 fed from the sheet feeding unit is guided by a guide member 45, a counter roller 46, a transport guide member 47, and a pressing member 48 having a tip-pressing roller 49. The sheet 42 is eventually transported under the recording head 34 by a transport belt 51 as a transport unit onto which the sheet 42 is electrostatically attached. The transport belt 51 is an endless belt extended around a transport roller 52 and a tensioning roller 53. The transport belt 51 is rotated by a sub-scan motor (not shown) via a timing belt in a belt transport direction (sub-scan direction). A surface of the transport belt 51 is charged by a charging roller 56 as a charging unit. The charging roller 56 is disposed to contact an upper layer of the transport belt 51 so that the charging roller 56 rotates following the rotation of the transport belt 51.

The apparatus main body 1 of the inkjet recording apparatus further includes a sheet-ejecting unit for ejecting the sheet 42 after it has been recorded by the head 34. The sheet-ejecting unit includes a separating nail 61 for separating the sheet 42 from the transport belt 51, a sheet-ejecting roller 62, and a spur 63 as another sheet-ejecting roller. Below the sheet-ejecting roller 62, there is disposed an ejected sheet tray 3.

At the rear of the apparatus main body 1, there is detachably mounted a double-side print unit 71. The double-side print unit 71 is configured to take in the sheet 42 as the sheet 42 is returned by a reverse rotation of the transport belt 51, turn back the sheet 42, and feed it again between the counter roller 46 and the transport belt 51. A manual feed tray 72 is mounted on the double-side print unit 71.

Referring to FIG. 2, in a non-printed region at one end of the main scan direction of the carriage 33, a maintenance/recovery mechanism 81 for maintaining or recovering a condition of the nozzles of the recording head 34 is disposed. The maintenance/recovery mechanism 81 includes caps 82*a* and 82*b* (which may be hereafter referred to collectively as a cap 82); a wiper member (wiper blade) 83 for wiping the nozzle surfaces; a blank ejection receptacle 84 for receiving ink droplets when a blank ejection is performed to eject droplets of ink with increased viscosity that do not contribute to recording; and a carriage lock 87 for locking the carriage 33.

Under the maintenance/recovery mechanism 81, there is disposed a first fixed waste fluid tank 100 for collecting a waste fluid produced by a blank ejection into the blank ejection receptacle 84, and a waste fluid that accumulates in the blank ejection receptacle 84 as a result of cleaning of the wiper member 83. At one side of the maintenance/recovery mechanism 81 and below the cartridge loading unit 4, there is disposed a second waste fluid tank 101 that can be accessed and replaced from the front of the apparatus main body 1. Specifically, the ink cartridge 10 and the first waste fluid tank 101 can be replaced by opening a common cover on the front surface of the apparatus main body 1, thus contributing to a reduction of cost.

Still referring to FIG. 2, in another non-printed region at the other end of the main scan direction of the carriage 33, there is disposed a blank ejection receptacle 88 for receiving ink droplets when a blank ejection is performed to eject droplets that do not contribute to recording, thus ejecting the recording fluid with increased viscosity. The blank ejection receptacle 88 includes openings 89 extending along the lines of nozzles of the recording head 34.

Referring to FIG. 1, an operation of the image forming apparatus is described. One of the sheets 42 is separated from the sheet-feed tray 2 and fed substantially vertically upward while being guided by the guide 45. The sheet 42 is further transported between the transport belt 51 and the counter roller 46, with the tip of the sheet 42 being guided by the transport guide 47. The sheet 42 is then pressed against the transport belt 51 by the tip-pressing roller 49 while executing a change in the transport direction of the sheet 42 by substantially 90°.

At this time, positive and negative alternating voltages are applied to the charging roller 56 so that the transport belt 51 can be charged with a pattern of alternating charging voltages. As a result, the transport belt 51 is charged with bands of predetermined widths of positive and negative charges alternating in the direction of rotation of the belt, i.e., in the sub-scan direction. The sheet 42 as it is fed onto the thus charged transport belt 51 electrostatically attaches to the transport belt 51, and is therefore transported in the sub-scan direction as the transport belt 51 moves.

The recording head 34 is driven in accordance with an image signal while the carriage 33 is moved in the main scan direction, whereby ink droplets are ejected onto the sheet 42 when it is stationary, recording one line of the image on the sheet 42. Then, the sheet 42 is transported by a predetermined amount in the sub-scan direction to record the next line of the image. The recording operation ends upon reception of a record end signal or a signal indicating the arrival of the rear-edge of the sheet 42 at the recording region, followed by the ejection of the sheet 42 onto the ejected sheet tray 3.

When a maintenance or recovery operation is performed on the nozzles of the recording head 34, the carriage 33 is moved to a home position opposite the maintenance/recovery mechanism 81. There, the nozzles are capped with the cap member 82 and a maintenance/recovery operation is performed which may involve sucking the ink via the nozzles or blank-discharging ink droplets that do not contribute to image formation. In this way, a stable image formation by the ejection of ink droplets can be ensured.

Figure 3:
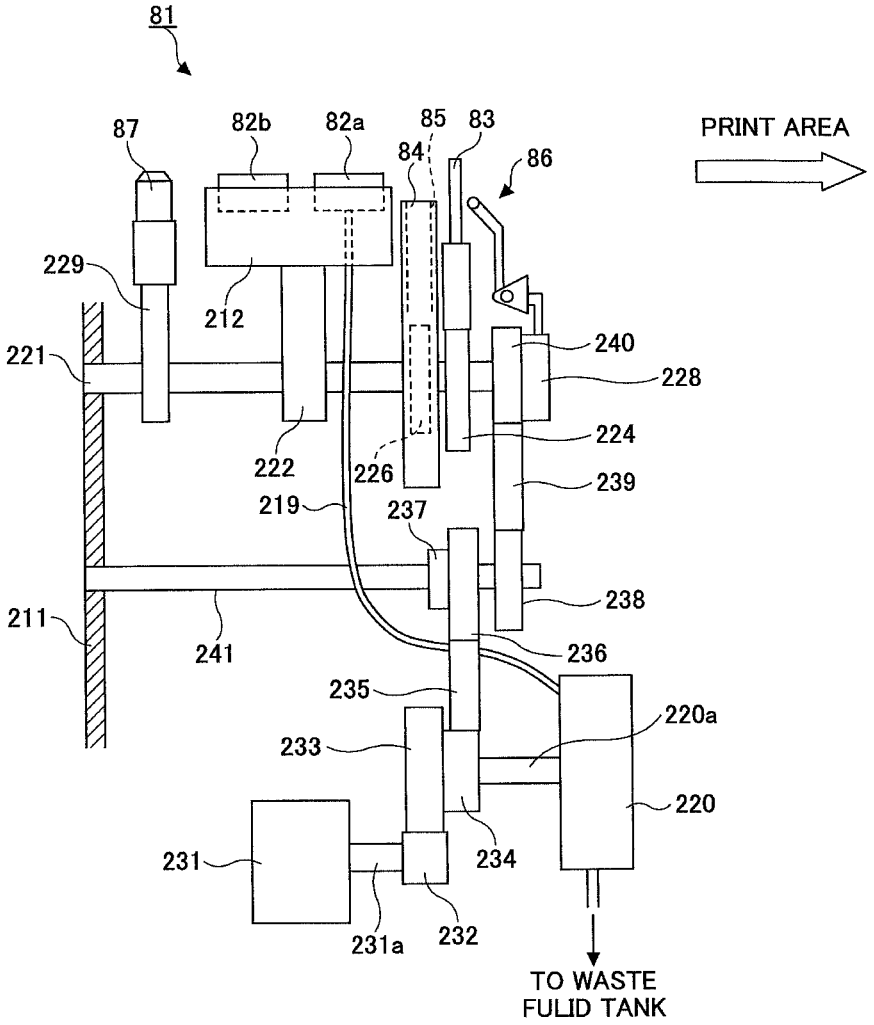
FIG. 3 shows a maintenance/recovery mechanism.
Figure 4:
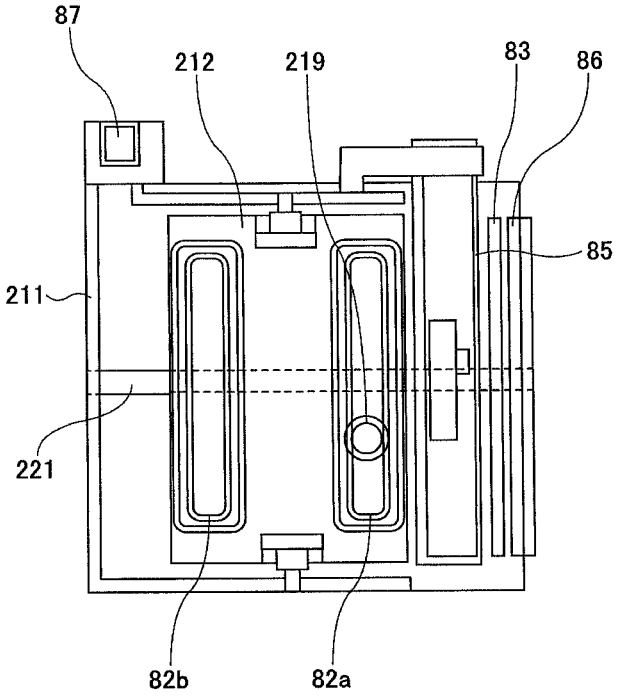
FIG. 4 is a plan view of a main portion of the maintenance/recovery mechanism.

Hereafter, the maintenance/recovery mechanism 81 of the image forming apparatus is described with reference to FIGS. 3 and 4. FIG. 3 schematically shows the structure of the maintenance/recovery mechanism 81 according to an embodiment of the present invention. FIG. 4 is a plan view of a main portion of the maintenance/recovery mechanism 81. The maintenance/recovery mechanism 81 includes a maintenance apparatus frame 211, a cap holder 212 holding caps 82*a* and 82*b*, a wiper member 83 including a resilient member, and a wiper cleaner 86 which is a first wiper cleaning unit. The cap holder 212, the wiper member 83, the wiper member 83, and the wiper cleaner 86 are vertically movably retained.

The cap 82 is a box-like member having an opening on the side facing the nozzle surfaces of the recording head 34. The cap 82 has a resilient portion at the top so that, by contacting the resilient portion against the nozzle surface in an airtight manner, the opening of the nozzle can be sealed (or capped).

The cap 82 contains a porous spongy absorption member (not shown) that enables the ink to be held within the cap 82 uniformly due to its capillary force. Thus, a negative pressure can be produced in the cap 82*a* by a suction pump 220 for ejecting the ink therein, as described below.

Between the wiper member 83 and the cap 82*a* is disposed a tubular blank ejection receptacle 84 as shown in FIG. 3. At the upper end of the blank ejection receptacle 84 on the side facing the wiper member 83, there is formed a wiper cleaner portion 85 as a second wiper cleaning unit for removing the ink attached on the wiper member 83. When cleaning, the wiper member 83 is lowered while being pressed against the wiper cleaner portion 85 by the wiper cleaner 86, so that the ink on the wiper member 83 can be scraped off into the blank ejection receptacle 84.

A flexible suction tube 219 connects to the cap 82*a*, which is the closer of the caps to the printed region, from a tubing pump (suction pump) 220 as a suction unit. The cap 82*a* alone may be used as a suction (recovery)/moistening cap (which may be hereafter simply referred to as a "suction cap"), with the cap 82*b* simply being used as a moistening cap. In this case, when a recovery operation for the recording head 34 is performed, the recording head 34 is selectively moved to a position where the head can be capped with the suction cap 82*a*. The suction pump 220 may produce a suction force in the tube 219 by repeatedly pressurizing and moving plural pressurizing members.

The suction tube 219 may be made of silicon. Preferably, since the suction tube 219 temporarily holds the ink therein, the suction tube 219 is formed of a material that resists the permeation of moisture through the tube walls. Thus, in the present embodiment, a thermoplastic elastomer tube is used. The thermoplastic elastomer may include a polystyrene thermoplastic elastomer, a polyolefin thermoplastic elastomer, a polydiene thermoplastic elastomer, a polyvinylchloride thermoplastic elastomer, a chlorinated polyethylene thermoplastic elastomer, a polyurethane thermoplastic elastomer, a polyester thermoplastic elastomer, a polyamide thermoplastic elastomer, and a fluororesin thermoplastic elastomer.

The hardness of the thermoplastic elastomer used for the suction tube 219 may be 50 according to the JIS-A standard, whereby a resilient force that enables the sending of fluid by pumping can be obtained while reducing the pumping load applied to the motor. The vapor permeability of the thermoplastic elastomer used for the suction tube 219 may be 15 $g/m^2$/day or smaller. In this way, the rate at which the retained ink evaporates from the tube 219 can be reduced, allowing the temporary storage of the ink in the tube 219.

As shown in FIG. 3, below the caps 82*a* and 82*b*, the wiper member 83, and the like, a cam shaft 221 is rotatably supported on the frame 211. The cam shaft 221 supports a cap cam 222 for lifting and lowering the cap holder 212; a wiper cam 224 for lifting and lowering the wiper member 83; a roller 226 as a rotating body within the blank ejection receptacle 84 onto which ink droplets are ejected during a blank ejection; a cleaner cam 228 for swinging the wiper cleaner 86; and a carriage lock cam 229 for lifting and lowering the carriage lock 87.

For the rotation of the suction pump 220 and the cam shaft 221, a maintenance/recovery motor 231 is provided. A motor shaft 231*a* of the motor 231 is fitted with a motor gear 232 that is meshed with a pump gear 233 fitted on a pump shaft 220*a* of the suction pump 220. The pump gear 233 is integral with an intermediate gear 234 that is coupled with an intermediate gear 236 via an intermediate gear 235. The intermediate gear 236 is fitted with a one-way clutch 237. The intermediate gear 236 is coaxial with an intermediate gear 238 that is meshed with an intermediate gear 239. The intermediate gear 239 is meshed with a cam gear 240 fixed on the cam shaft 221. An intermediate shaft 241 that is the rotating shaft of the intermediate gear 236 and the intermediate gear 238 is rotatably supported by the frame 211.

When removing the ink or impurities that have attached to the nozzle surface of the recording head 34, the motor 231 is driven to lift the wiper member 83 via the wiper cam 224. The carriage 33 is then moved in the main scan direction so that the nozzle surface of the recording head 34 can he wiped with the wiper member 83, thus removing the ink or impurities.

When the nozzles of the recording head 34 are left standing while exposed to the outside air, the ink inside the nozzles dries and its viscosity increases, thereby adversely affecting ink ejection performance. In order to prevent this, the nozzle surfaces of the recording head 34 are covered with the cap 82 by rotating the motor 231 to lift the cap 82 via the cap cam 222. Before, after, and/or during a recording operation, ink droplets that do not contribute to recording are ejected (preliminary ejection) onto the blank ejection receptacle 88 or the cap 82*a* in order to maintain nozzle ejection performance.

Embodiment 1

Hereafter, the second waste fluid tank in the above-described image forming apparatus according to a first embodiment of the present invention is described with reference to FIGS. 5 through 12.

As mentioned above, the image forming apparatus includes the first waste fluid tank 100 that is fixed for storing the waste fluid (waste ink) from the blank ejection receptacle 84 of the maintenance/recovery mechanism 81, and the second waste fluid tank 101 that is detachable for storing the waste fluid discharged from the cap 82*a*.

The second waste fluid tank 101 is an airtight container including a container main body 111 and a lid member 112. It houses an absorption member 113 of a multilayered structure (three layers in the illustrated embodiment) consisting of an absorbing body made from nonwoven cloth or spongy material for absorbing and holding ink (waste fluid). The container main body (casing) 111 and the lid member 112 may be welded, or sealed with a resilient member such as a packing disposed therebetween.

Figure 5:
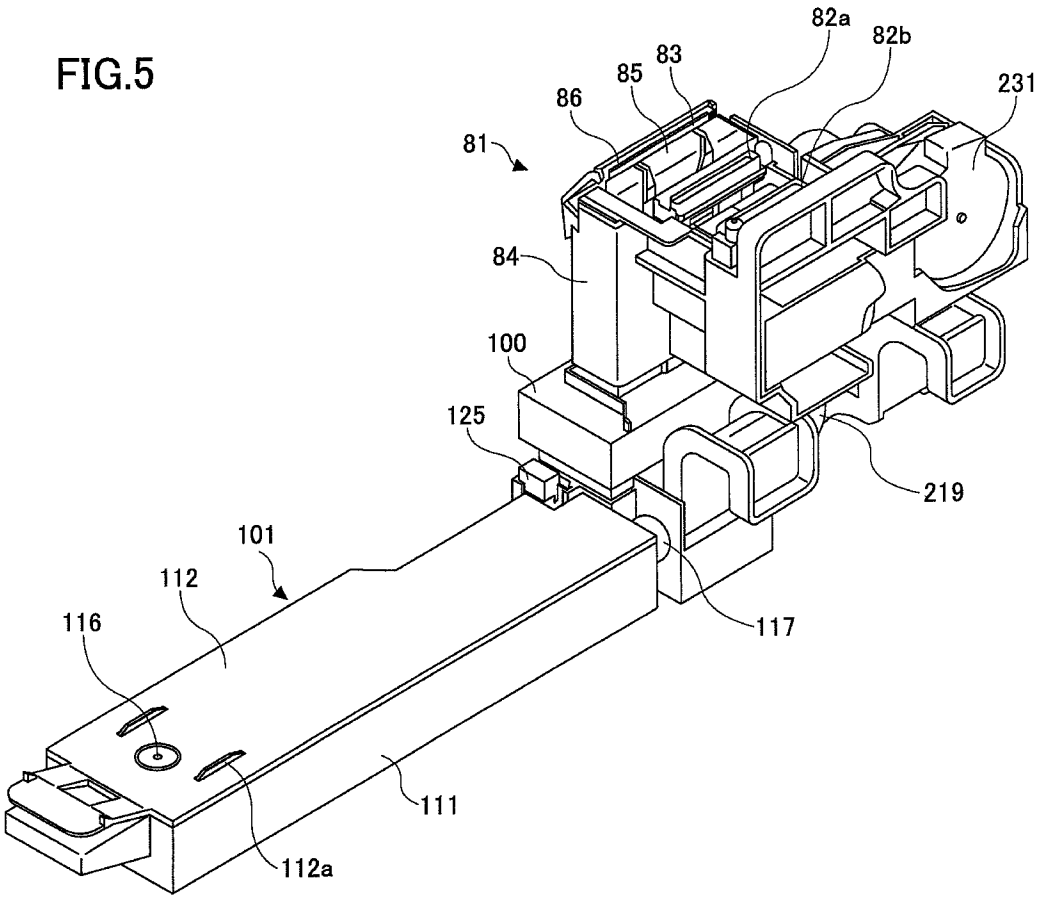
FIG. 5 shows a perspective view of the maintenance/recovery mechanism and a second waste fluid tank.
Figure 6:
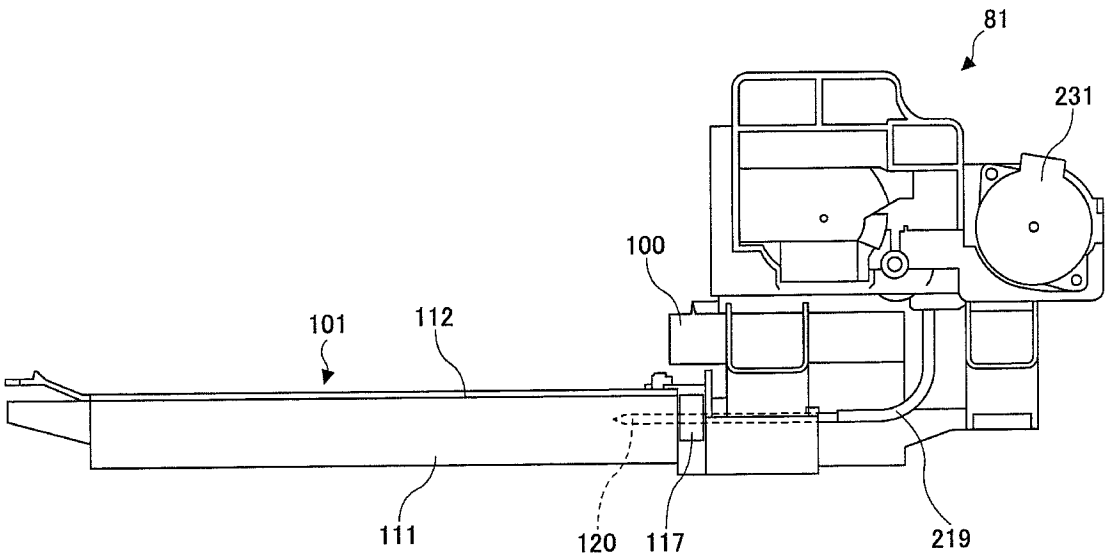
FIG. 6 shows a side view of the maintenance/recovery mechanism and a second waste fluid tank.
Figure 7:
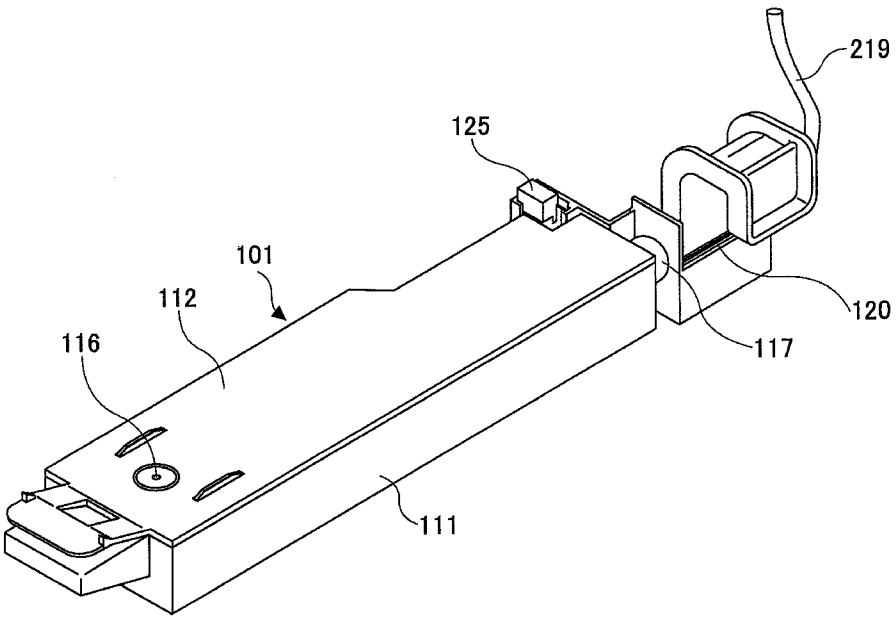
FIG. 7 shows a perspective view of the second waste fluid tank.
Figure 8:
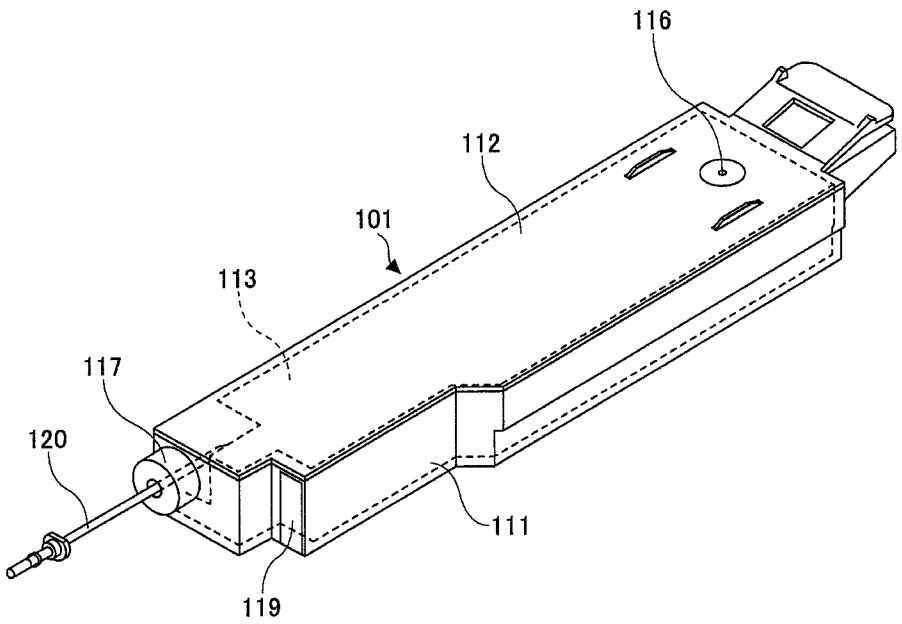
FIG. 8 shows a perspective view of the second waste fluid tank as seen from the opposite end from FIG. 7.

Referring to FIG. 5, for example, on one end of the second waste fluid tank 101 in the longitudinal direction thereof, a waste fluid inlet portion 117 is provided. To the waste fluid inlet portion 117, a waste fluid discharged-end of the suction tube 219 is connected via a needle 120 as a coupling member in a hermetically detachable manner, as shown in FIGS. 6 and 8, for example. In an upper surface at the other end of the second waste fluid tank 101, an atmosphere communicating opening 116 is provided that communicates the inside and outside of the tank, as shown in FIG. 7. The size of the atmosphere communicating opening 116 should be as small as possible because a large opening would allow the waste fluid to leak out of the second waste fluid tank 101 easily, thus promoting the drying of the waste fluid stored in the second waste fluid tank 101.

Figure 9:
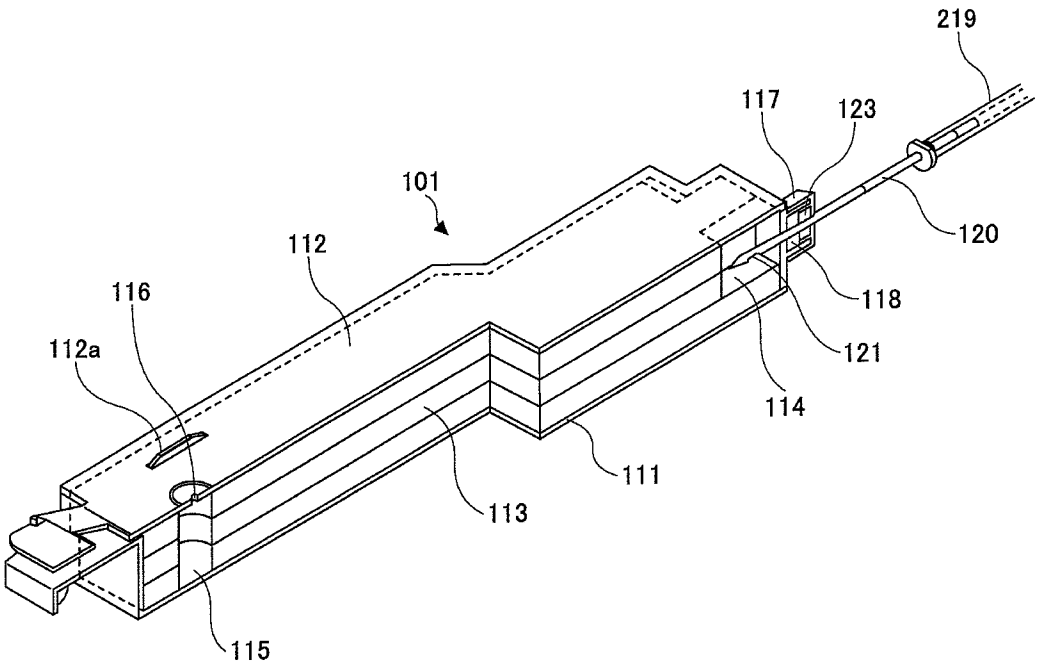
FIG. 9 shows a cross-sectional perspective view of the second waste fluid tank.
Figure 10:
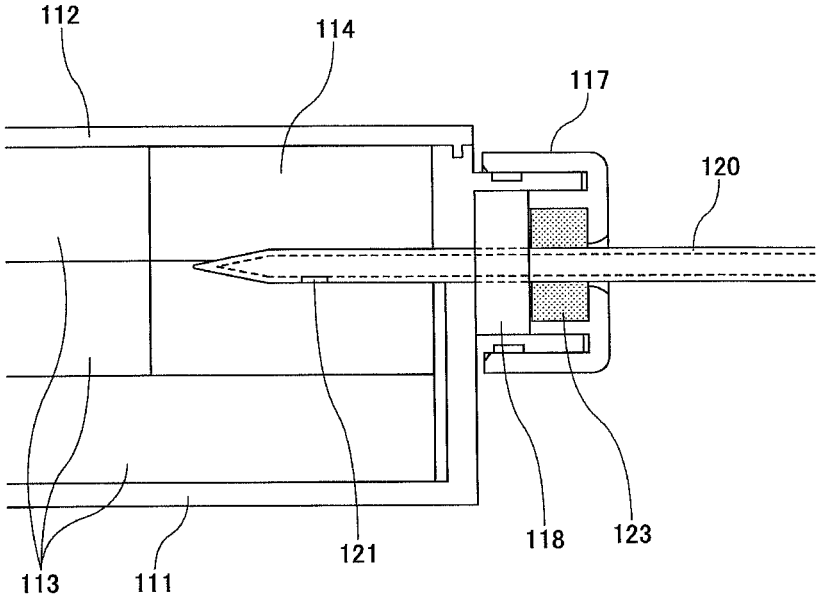
FIG. 10 shows an enlarged cross section of a coupling portion between the second waste fluid tank and a suction tube.

Referring to FIGS. 9 and 10, the absorption member 113 in the second waste fluid tank 101 has a waste fluid introducing space 114 formed where the waste fluid is introduced via an opening portion 121 of the needle 120. There is also formed a space 115 at the back corresponding to the atmosphere communicating opening 116 through the three layers of the absorption member 113, as shown in FIG. 9. The absorption member 113 disposed between the waste fluid introducing space 114 and the atmosphere communicating opening 116 hampers the movement of air between the areas around the waste fluid inlet (waste fluid introducing space 114) and the areas around the atmosphere communicating opening 116. Thus, the drying of the waste fluid near the waste fluid introducing space 114 can be prevented.

The waste fluid introducing space 114 for the introduction of the waste fluid facilitates the insertion of the needle 120 and the replacement of the second waste fluid tank 101. If the waste fluid introducing space 114 were occupied by the absorption member 113, the needle 120 would have to penetrate the absorption member 113, which is difficult in practice because of the finely packed nature of the material of the absorption member 113. The space 115 at the position corresponding to the atmosphere communicating opening 116 prevents the leakage of bubbles of the waste fluid out of the atmosphere communicating opening 116, thus preventing the staining or contamination of the second waste fluid tank 101.

Figure 11A:
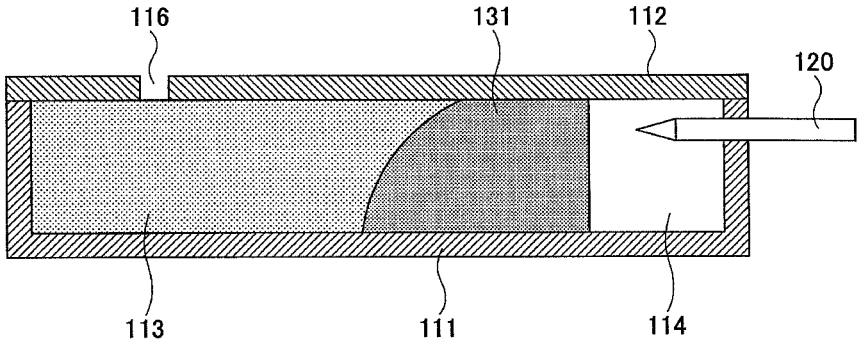
FIGS. 11A through 11C illustrate a process of development of bubbles via an atmosphere communicating opening.
Figure 11B:
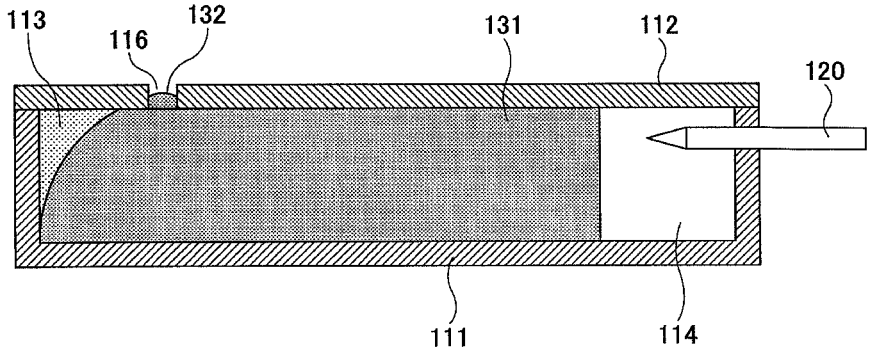
Figure 11C:
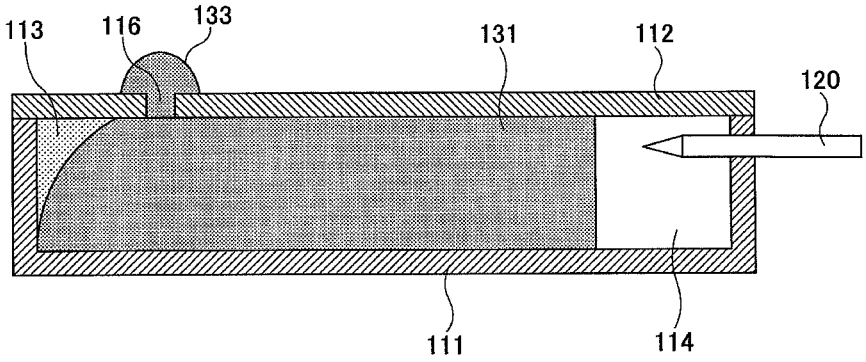
Figure 12:
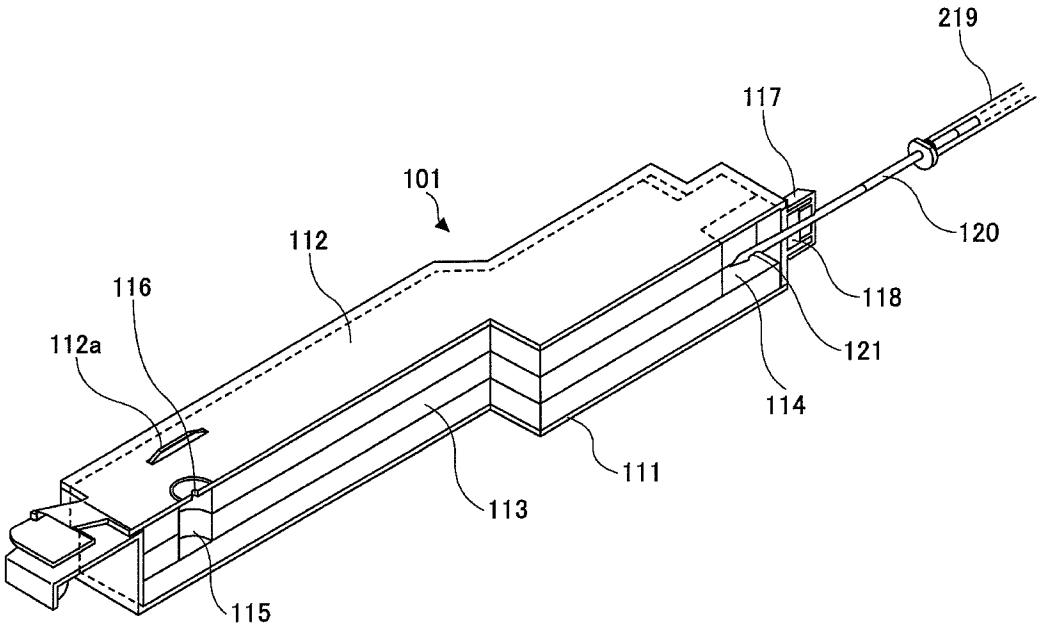
FIG. 12 shows a cross-sectional perspective view of the second waste fluid tank showing another example of the arrangement of the absorption member.

FIG. 11A through 11C illustrate what would happen if the absorption member 113 were present at the location of the atmosphere communicating opening 116. When the absorption member 113 is permeated with the waste fluid 131 as shown in FIG. 11A, air is let out via the atmosphere communicating opening 116 as the waste fluid 131 and air are introduced into the waste fluid introducing space 114. When the waste fluid 131 reaches the atmosphere communicating opening 116 as shown in FIG. 11B, a film 132 of the waste fluid 131 attaches to the atmosphere communicating opening 116. As air attempts to go out via the atmosphere communicating opening 116, the film 132 develops into a bubble 133 shown in FIG. 11C, which eventually bursts, thereby staining the second waste fluid tank 101.

In accordance with the present embodiment of the present invention, such development and bursting of the bubble 133 of the waste fluid 131 is prevented by the absence of the absorption member 113 at the atmosphere communicating opening 116. The same effect can be obtained by eliminating the absorption member adjacent the atmosphere communicating opening 116. Thus, in another embodiment shown in FIG. 12, the absorption member 113 may be present at the bottom of the multilayer structure.

Referring to FIG. 10, the waste fluid inlet portion 117 is internally fitted with a hollow resilient member 118 into which the needle 120 connecting to the suction tube 219 can be inserted to thereby couple the discharged-end portion of the suction tube 219 and the second waste fluid tank 101. The needle 120 may include a hollow structure with the opening 121 formed in the side at the tip through which the waste fluid sent via the suction tube 219 can be discharged into the introducing space 114.

The resilient member 118 seals the opening in it that is formed by the penetrating needle 120 by its own resilient force upon removal of the needle 120. Thus, the second waste fluid tank 101 can be replaced without the waste fluid leaking via the waste fluid inlet portion 117. The atmosphere communicating opening 116 of the replaced second waste fluid tank 101 may be affixed with a decal to completely seal the tank 101, thus preventing the leakage of the waste fluid out of the second waste fluid tank 101.

When the waste fluid is discharged from the needle 120, air is simultaneously let out of the opening portion 121 of the needle 120, so that the waste fluid with an increased viscosity due to the bubbles tends to attach to the tip of the needle 120. Also, if the waste fluid remains at the opening portion 121 of the needle 120 when the second waste fluid tank 101 is removed, the viscosity of the waste fluid may increase, resulting in sucking failure. Thus, an absorption member 123 is disposed on the outside of the resilient member 118 in the waste fluid inlet portion 117 (see FIGS. 9 and 10). When the needle 120 is pulled out of the second waste fluid tank 101, the tip of the needle 120 is scrubbed by the absorption member 123 as it leaves the second waste fluid tank 101, thereby preventing the clogging by the waste fluid.

If the opening portion 121 were provided at the tip of the needle 120, a small bit of the resilient member 118 may enter the opening portion 121 as the needle 120 penetrates the resilient member 118, possibly clogging the needle 120. Thus, the opening portion 121 is preferably provided on the side of the needle 120.

On a wall at the same side of the second waste fluid tank 101 as the waste fluid inlet portion 117, an information memory medium 119 is attached (see FIG. 8). The information memory medium 119 may store information about the amount of waste fluid discharged into the first waste fluid tank 101 or the remaining capacity. Such information in the information memory medium 119 may be read using a reader 125 installed on the side of the maintenance/recovery mechanism 81, as shown in FIG. 7.

In accordance with the present embodiment, a filled-up state of the second waste fluid tank 101 may be detected as follows. The amount of the waste fluid discharged into the second waste fluid tank 101 is determined by counting the number of drops ejected from the recording head 34 and the amount of each drop. If the measured value exceeds a predetermined value (threshold), it is determined that the second waste fluid tank 101 is full. When the second waste fluid tank 101 is replaced with a new one, the measured value is automatically reset.

On top of the lid member 112 of the second waste fluid tank 101, there is formed a rib 112*a* for preventing the movement of the second waste fluid tank 101 within the image forming apparatus, as shown in FIG. 9.

Thus, in the image forming apparatus of the present embodiment, the waste fluid created by the blank ejection and the cleaning of the wiper member 83 is collected in the first waste fluid tank 100, while the waste fluid from the cap 82*a* is collected in the second waste fluid tank 101.

The maintenance/recovery operation produces two kinds of waste fluid. One is the waste fluid from the suction tube 219 that is produced by the sucking of ink via the nozzle using the suction pump 220 with the nozzle surface being capped with the cap 82*a*, in order to recover from an ejection defect at the recording head nozzle. The other is the waste fluid produced by the blank ejection whereby ink droplets that do not contribute to image formation are ejected via the nozzle into a region outside the printed region (e.g., the blank ejection receptacle 84) and by the cleaning of the wiper member 83 with the wiper cleaner portion 85.

The waste fluid from the suction tube 219 has a relatively low viscosity because the ink is forcibly sucked out of the nozzle. On the other hand, the waste fluid by the blank ejection or the cleaning of the wiper member (which may be referred to as a "waste fluid from the blank ejection receptacle") is small in quantity and has a relatively high viscosity. By discharging the waste fluid of low viscosity alone into a sealed space, the accumulation of waste fluid can be reduced.

It is for this reason that the first waste fluid tank 100 and the second waste fluid tank 101 are provided, rather than discharging the waste fluid from the suction tube 219 and that from the blank ejection receptacle 84 into the same waste fluid tank. The second waste fluid tank 101 is structured in an airtight manner to slow the drying and leaking of the waste fluid. Thus, the deposition of the waste fluid in the second waste fluid tank 101 is reduced, thereby improving the utilization efficiency of the waste fluid tank. The second waste fluid tank 101 is detachable and can be readily replaced.

Figure 13:
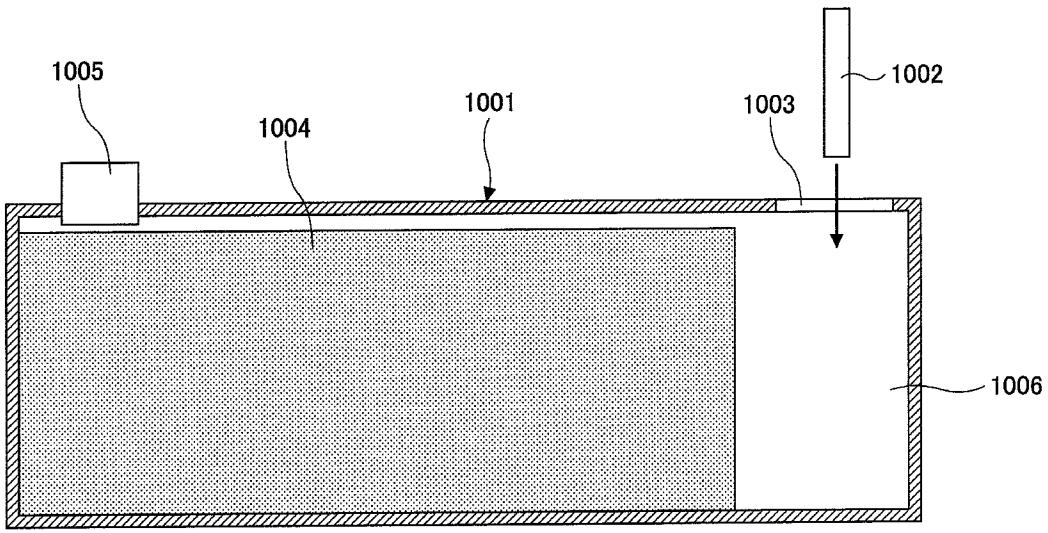
FIG. 13 schematically shows an open-type waste fluid tank.
Figure 14:
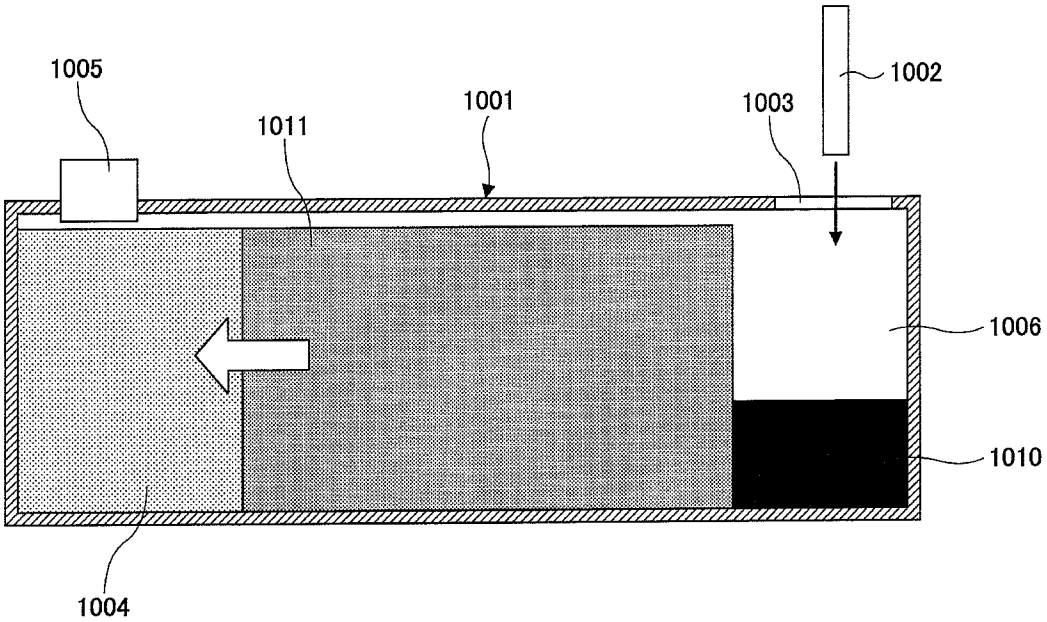
FIG. 14 illustrates a process of permeation of waste fluid in the open-type tank.
Figure 15:
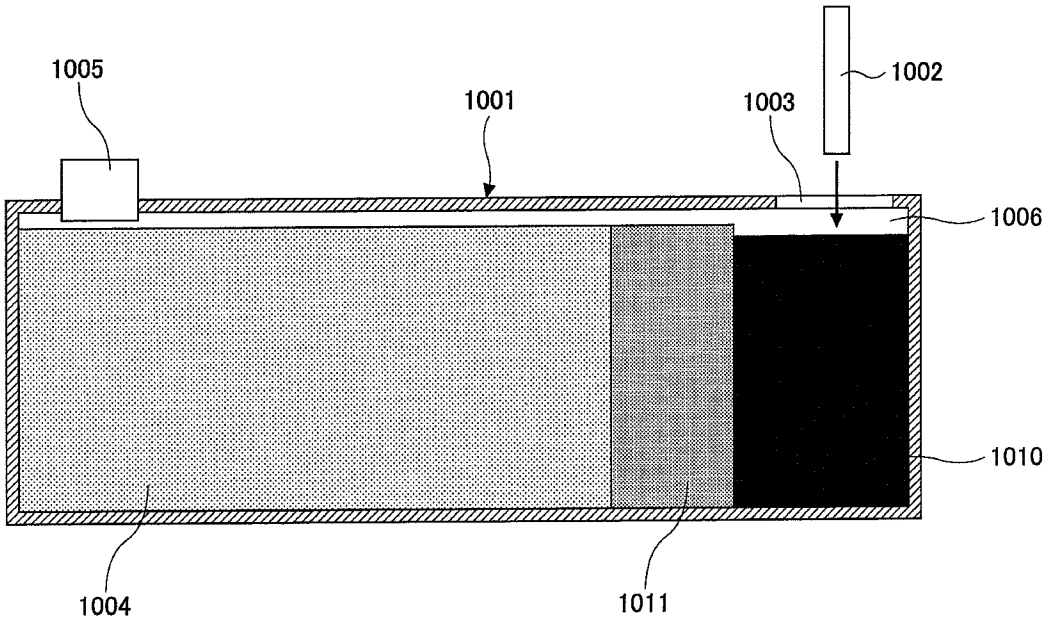
FIG. 15 illustrates the failure of permeation of waste fluid in the open-type tank.

Problems of an open-type waste fluid tank having an opening portion are discussed with reference to FIGS. 13 through 15. FIGS. 13 through 15 show an open-type waste fluid tank 1001 having an opening portion 1003 that is open at all times for the input of a waste fluid from the suction tube 1002. The open-type waste fluid tank 1001 contains an absorption member 1004. At a position spaced apart from the opening portion 1003, a fill-up detection sensor 1005 is installed.

Referring to FIG. 14, the waste fluid 1010 discharged from the suction tube 1002 into a waste fluid introducing space 1006 via the opening portion 1003 is absorbed and retained by the absorption member 1004. As long as the waste fluid 1010 is put into the open-type waste fluid tank 1001 via the opening portion 1003 regularly, no problem arises. However, if the waste fluid 1010 is allowed to stand for a long time in the waste fluid tank 1001, a waste fluid 1011 that is absorbed at the entry portion of the absorption member 1004 dries and increases in viscosity because of its constant exposure to the atmosphere via the opening portion 1003, as shown in FIG. 15. As the viscosity increases and reaches a certain point, the absorption member 1004 cannot absorb new waste fluid 1010 anymore, so that the fill-up detection sensor 1005 cannot function properly. If the discharge of the waste fluid 1010 into the open-type waste fluid tank 1001 continues, the waste fluid 1010 overflows out of the opening portion 1003 of the waste fluid tank 1010.

Thus, by employing the hermetically sealed structure of the waste tank as according to the present embodiment, evaporation of moisture can be prevented and also the overflowing of the waste fluid can be controlled.

Embodiment 2

Figure 16:
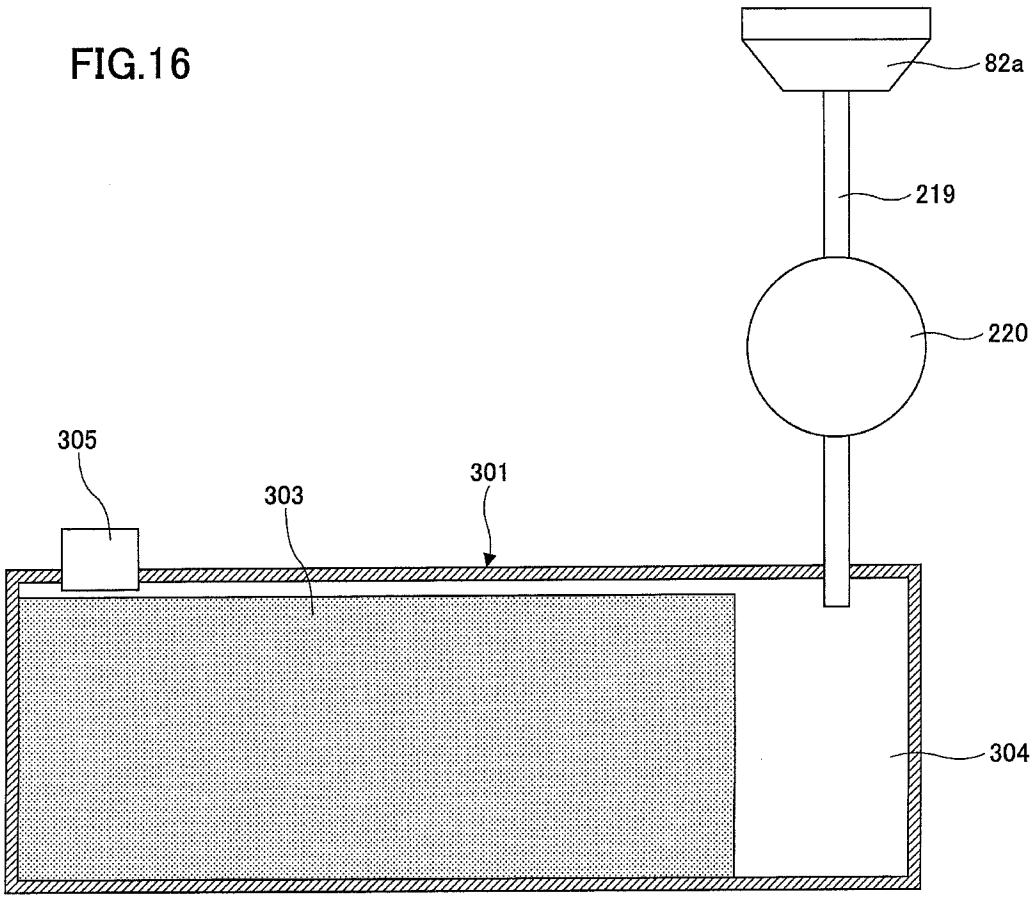
FIG. 16 shows the second waste fluid tank according to another embodiment of the present invention.

Hereafter, the second waste fluid tank according to a second embodiment of the present invention is described with reference to FIG. 16. The second waste fluid tank 301 shown in FIG. 16 is an airtight-structure container which may be constructed by hermetically integrating the container main body and the lid member according to the first embodiment by welding, fusing, or bonding, using a packing member (seal member) as needed.

On top of the second waste fluid tank 301, a suction tube 219 is connected at a waste fluid inlet portion in a hermetically sealed manner. A waste fluid introducing space 304 is formed at a location corresponding to the waste fluid inlet portion, via which a waste fluid is put into the second waste fluid tank 301 from the suction tube 219. Other than the waste fluid introducing space 304, the inside of the second waste fluid tank 301 is mostly occupied by an absorption member 303 for absorbing the waste fluid. At the opposite end of the second waste fluid tank 301 from the waste fluid introducing space 304 in the longitudinal direction of the tank, a fill-up detection sensor 305 is installed.

The suction tube 219 may be connected to the second waste fluid tank 301 via a detachable joint so that the second waste fluid tank 301 can be replaced. Further, between the suction tube 219 and the second waste fluid tank 301, a valve (open/close unit) may be installed in order to open or close the communication between the cap 82*a* which is open to the atmosphere and the inside of the tank. The open/close unit is opened when the waste fluid is discharged into the second waste fluid tank 301. When a suction pump 220 comprises a tubing pump, the suction tube 219 may be compressed by a pressurizing roller in the tubing pump in a deactivated state, the suction pump 220 thus functioning as a valve.

Thus, in accordance with the present embodiment, the waste fluid tank has a completely airtight structure, so that the evaporation of moisture and the leakage of the waste fluid can be prevented.

Embodiment 3

Figure 17:
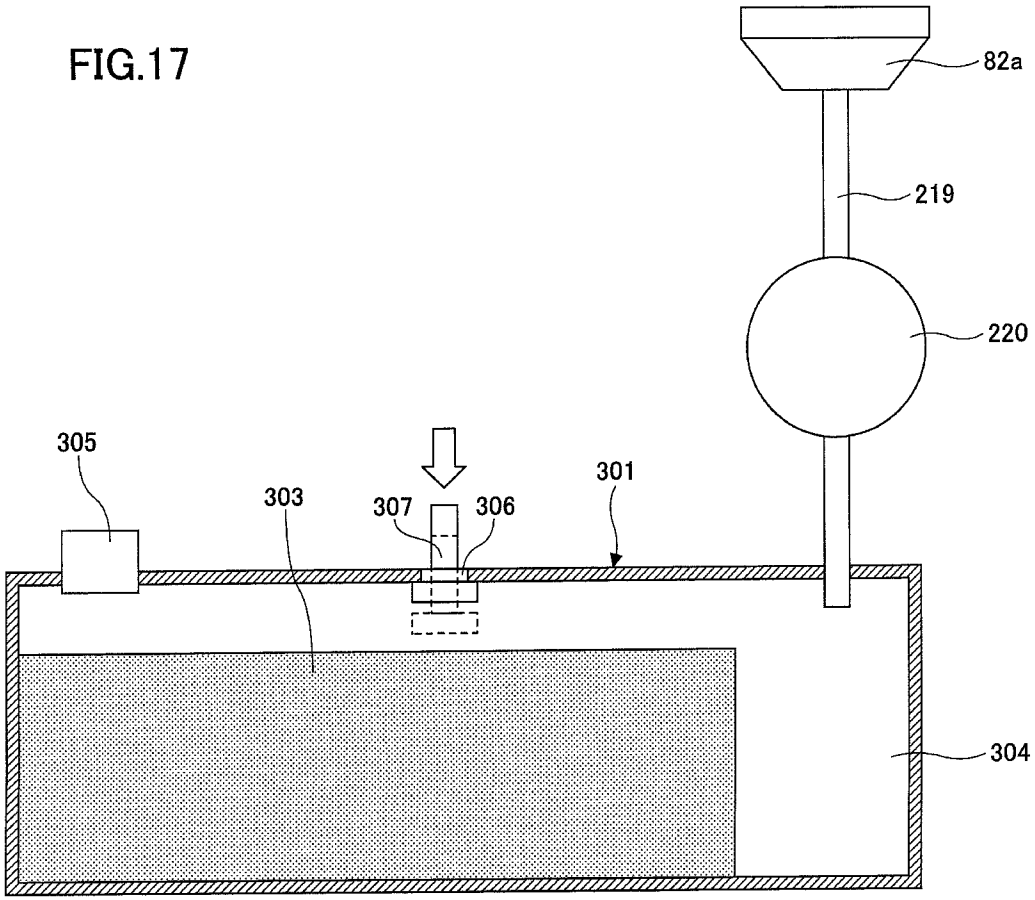
FIG. 17 shows the second waste fluid tank according to another embodiment of the present invention.

In the following, the second waste fluid tank according to a third embodiment of the present invention is described with reference to FIG. 17. According to the third embodiment, a communicating opening 306 is provided in the second waste fluid tank 301 of the second embodiment, wherein an atmosphere opening valve 307 is installed as an open/close unit for opening or closing the communicating opening 306.

When discharging a waste fluid into the second waste fluid tank 301, the atmosphere opening valve 307 is opened to open the inside of the tank to the atmosphere via the communicating opening 306. Thus, the internal air can be let out via the communicating opening 306 when the waste fluid is discharged into the second waste fluid tank 301, thus allowing the introduction of the waste fluid into the airtight structure.

Embodiment 4

Figure 18:
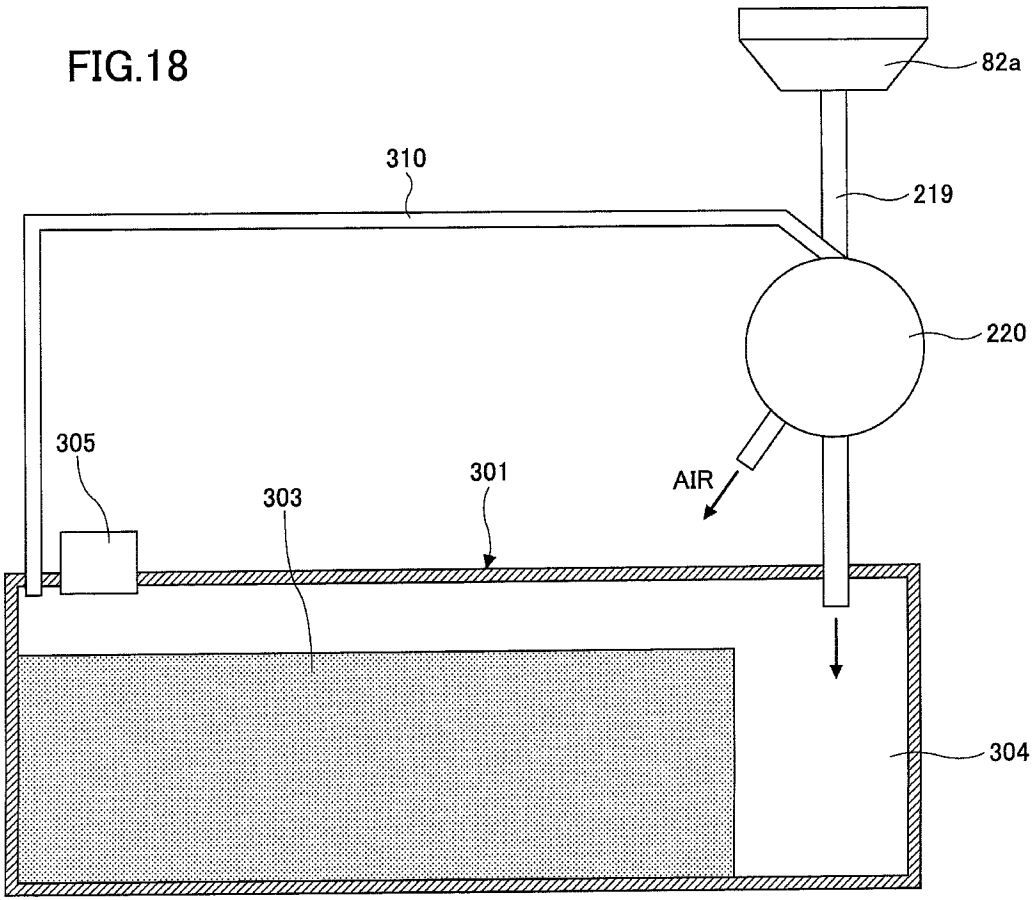
FIG. 18 shows the second waste fluid tank according to another embodiment of the present invention.

Hereafter, the second waste fluid tank according to a fourth embodiment of the present invention is described with reference to FIG. 18. In accordance with the fourth embodiment, the second waste fluid tank 301 according to the second embodiment is fitted with an air suction tube 310 for creating a negative pressure inside the second waste fluid tank 301 by sucking air therefrom. A sucking force is created in the air suction tube 310 by the suction pump 220.

When discharging a waste fluid into the second waste fluid tank 301, the air inside the second waste fluid tank 301 is sucked by the suction pump 220, thereby creating a negative pressure therein. The negative pressure enables the introduction of the waste fluid into the airtight structure of the second waste fluid tank 301. When the suction pump 220 is deactivated, the tube 219 may be compressed by the pressing roller when the suction pump 220 comprises a tubing pump. Thus, the hermetic sealing of the second waste fluid tank 301 can be maintained.

Thus, in accordance with the fourth embodiment, a negative pressure creating unit is employed to enable the discharge of the waste fluid into the hermetically sealed waste fluid tank. In other words, the negative pressure creating unit enables the waste fluid tank to be made completely airtight. Although the suction pump 220 for sucking the waste fluid within the suction cap 82*a* doubles as a negative pressure creating unit, a separate unit for creating a negative pressure within the waste fluid tank may be provided.

Embodiment 5

Figure 19:
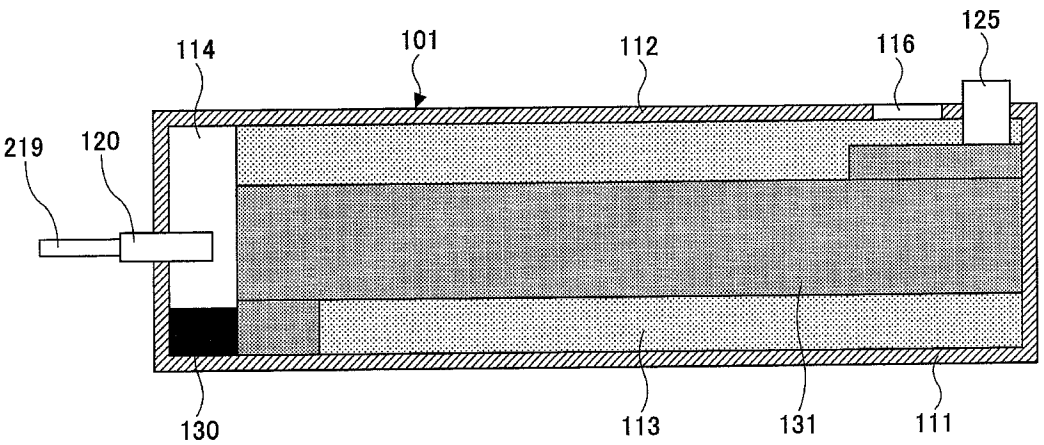
FIG. 19 shows the second waste fluid tank according to another embodiment of the present invention.
Figure 20B:
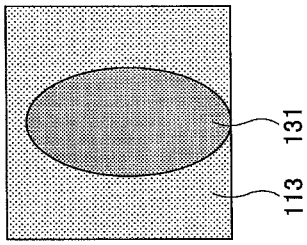
FIG. 20B shows a cross section of FIG. 20A.

Hereafter, the second waste fluid tank according to a fifth embodiment of the present invention is described with reference to FIGS. 19 and 20. In accordance with the fifth embodiment, the filled-up state of the second waste fluid tank 101 is detected using an optical fill-up detection sensor 125. The fill-up detection sensor 125 is installed at the opposite end of the second waste fluid tank 101 from the atmosphere communicating opening 116. Thus, the atmosphere communicating opening 116 is disposed between the waste fluid introducing space 114 and the fill-up detection sensor 125.

Figure 20A:
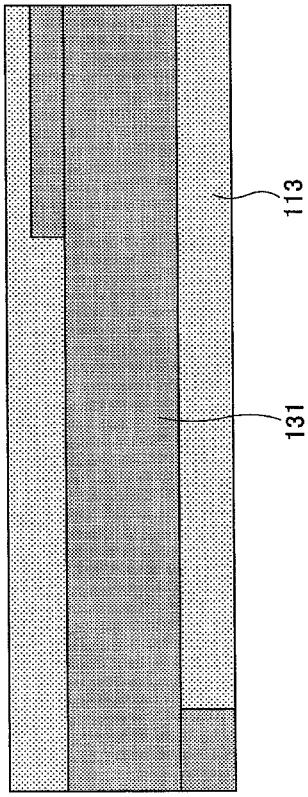
FIG. 20A shows how the absorption member in the second waste fluid tank is permeated with waste fluid.

As shown in FIG. 20A, a waste fluid 130 that is put into the waste fluid introducing space 114 is absorbed by the absorption member 113. As the waste fluid 131 reaches the end of the tank through the absorption member 113, the fill-up detection sensor 125 detects the waste fluid 131 and thus the filled-up state. In this way, an improved utilization efficiency of the second waste fluid tank 101 can be obtained.

Figure 21:
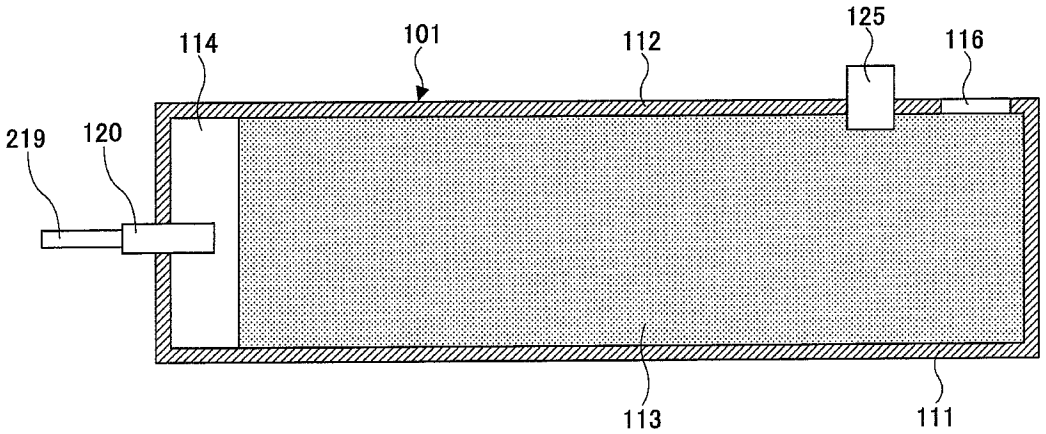
FIG. 21 shows a second waste fluid tank according to a comparative example.
Figure 22:
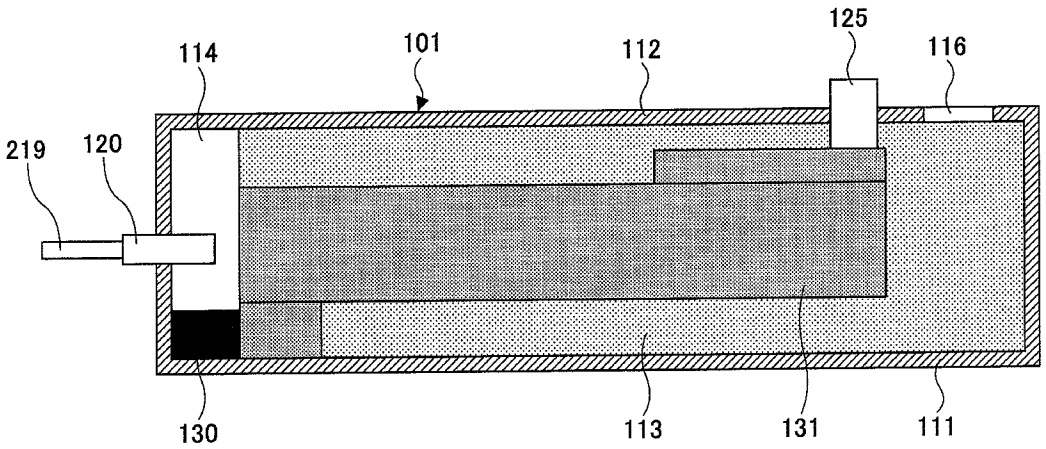
FIG. 22 illustrates how waste fluid permeates the second waste fluid tank according to the comparative example.
Figure 23B:
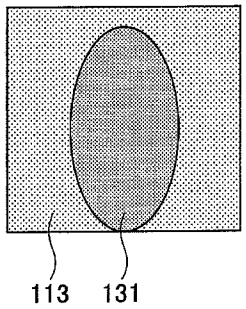
FIG. 23B shows a cross section of FIG. 23A.
Figure 23A:
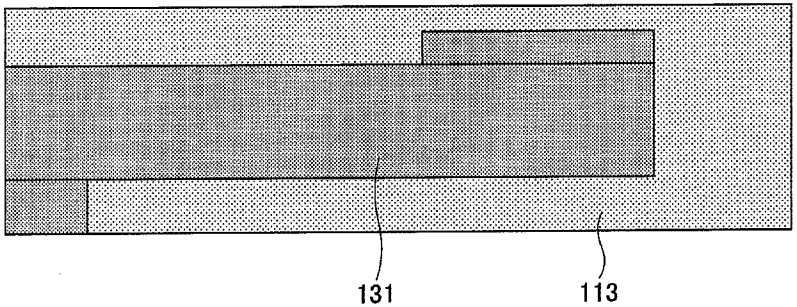
FIG. 23A shows how the absorption member in the second waste fluid tank according to the comparative example is permeated with waste fluid.

In this respect, a comparative example is described with reference to FIGS. 21 through 23. In this comparative example, the fill-up detection sensor 125 is mounted on the side of the waste fluid introducing space 114 from the atmosphere communicating opening 116, as shown in FIG. 21. In this case, it has been found that, although the waste fluid 130 permeates toward the atmosphere communicating opening 116 through the absorption member 113, a waste fluid absorption path is formed up to the location of the fill-up detection sensor 125 within the absorption member 113, i.e., before reaching the atmosphere communicating opening 116, as shown in FIG. 22. Thus, as shown in FIG. 23A, the region of the absorption member 113 in which the waste fluid 131 is absorbed is limited, and a fill-up detection signal is produced before the waste fluid is sufficiently absorbed by the absorption member 113. As a result, the utilization efficiency of the waste fluid tank decreases.

On the other hand, when the fill-up detection sensor 125 is disposed behind the atmosphere communicating opening 116 (as seen from the waste fluid inlet portion) as according to the present embodiment, the waste fluid can be absorbed up to the end of the absorption member 113, so that an improved waste fluid tank utilization efficiency can be obtained.

Embodiment 6

Figure 24:
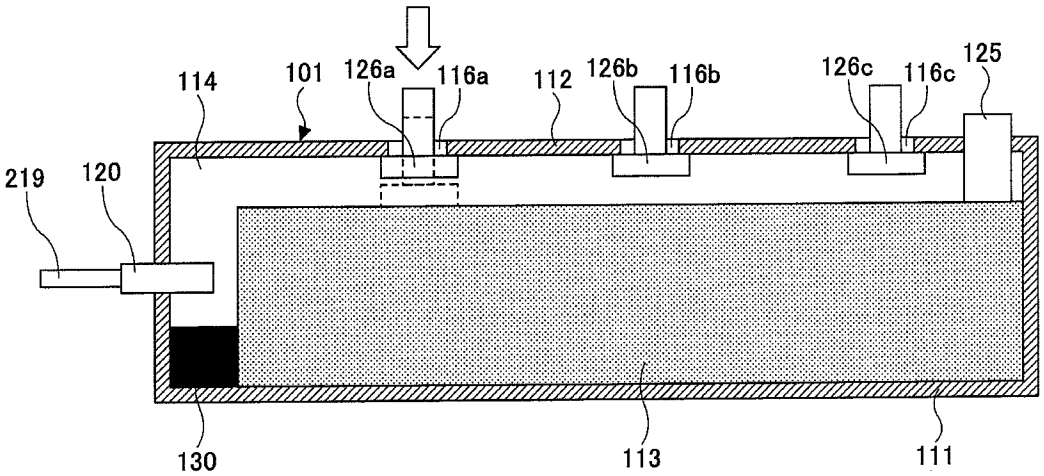
FIG. 24 shows the second waste fluid tank according to another embodiment of the present invention.

Hereafter, the second waste fluid tank according to a sixth embodiment of the present invention is described with reference to FIGS. 24 and 25. According to the sixth embodiment, the second waste fluid tank 101 is provided with a plurality (three in the illustrated example) of atmosphere communicating openings 116*a* to 116*c* between the waste fluid introducing space 114 and the fill-up detection sensor 125, along the longitudinal direction of the tank in which the waste fluid permeates. These openings 116*a* to 116*c* are fitted with open/close valves 126*a* to 126*c* for opening or closing the respective atmosphere communicating openings 116*a* to 116*c*.

Figure 25B:
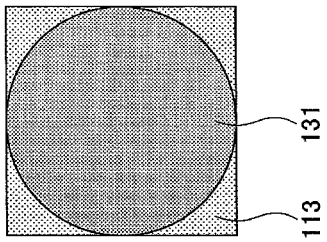
FIG. 25B shows a cross section of FIG. 25A.
Figure 25A:
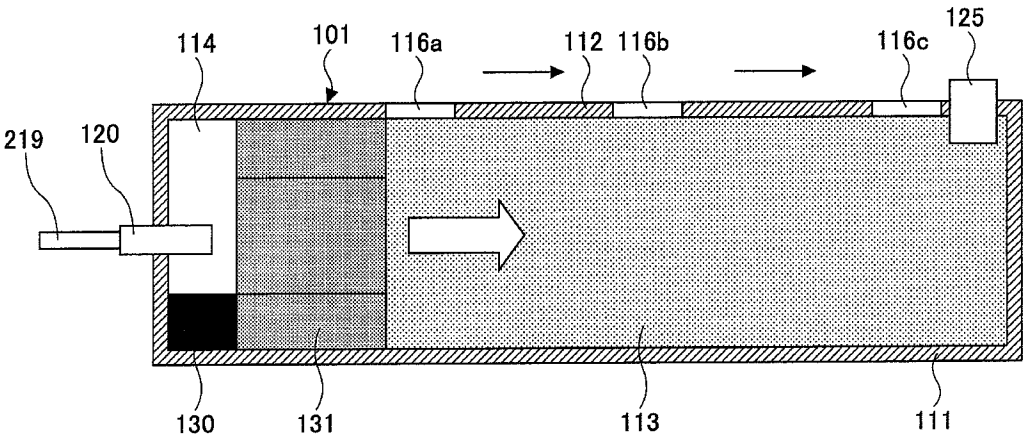
FIG. 25A illustrates an operation of the second waste fluid tank according to the embodiment of FIG. 24.

In this second waste fluid tank 101, when the waste fluid is discharged, the open/close valves 126*a* to 126*c* are opened or closed successively depending on the amount of discharged waste fluid, as indicated by arrows in FIG. 25. Specifically, initially the atmosphere communicating opening 116*a* is opened while the atmosphere communicating openings 116*b* and 116*c* are closed. When the waste fluid discharged amount reached a first predetermined amount, the atmosphere communicating opening 116*a* is closed and the atmosphere communicating opening 116*b* is opened, with the atmosphere communicating opening 116*c* still closed. When the waste fluid discharged amount reached a second predetermined amount, the atmosphere communicating openings 116*a* and 116*b* are closed, while the atmosphere communicating opening 116*c* is opened. When not discharging the waste fluid, all of the open/close valves 126*a* to 126*c* are closed, so that the second waste fluid tank 101 can be completely hermetically sealed, thus preventing the drying of waste fluid.

In this case, the first predetermined amount may be set to such an amount that the waste fluid 131 that permeated the absorption member 113 does not go beyond the atmosphere communicating opening 116*a*, and the second predetermined amount may be set to such an amount that the waste fluid 131 that permeated the absorption member 113 does not go beyond the atmosphere communicating opening 116*b*. In this way, the waste fluid 131 that has been absorbed by the absorption member 113 can be prevented from overflowing via the atmosphere communicating opening 116*a* or 116*b*, thereby allowing the waste fluid to be absorbed by the entirety of the absorption member 113. Thus, the amount of waste fluid absorbed by the absorption member 113 can be increased compared to the fifth embodiment.

Figure 26B:
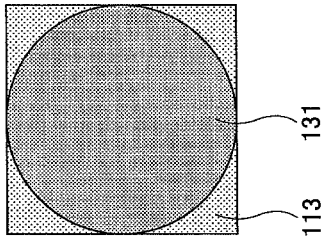
FIG. 26B shows a cross section of FIG. 26A.
Figure 26A:
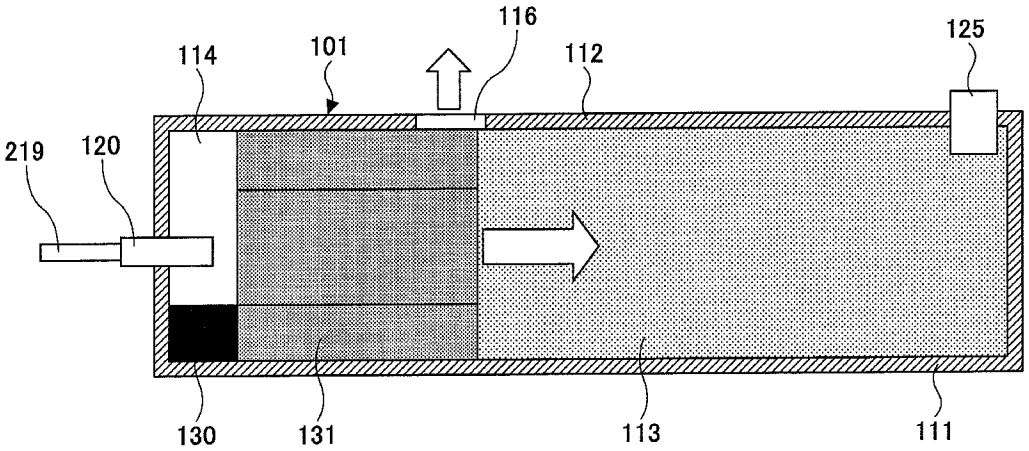
FIG. 26A shows a second waste fluid tank according to a comparative example illustrating how the absorption member is permeated with waste fluid in the comparative example.

In accordance with the preceding fifth embodiment, although the amount of waste fluid absorbed by the absorption member can be increased, the filled-up status may be detected when there is still insufficient permeation of waste fluid in the lateral direction (see FIG. 20B) relative to permeation in the longitudinal direction, if the distance between the atmosphere communicating opening 116 and the fill-up detection sensor 125 is small. Further, if the interval between the atmosphere communicating opening 116 and the fill-up detection sensor 125 is increased as shown in FIG. 26A, although the permeation of waste fluid in the absorption member 113 may be improved up to around the atmosphere communicating opening 116 (see FIG. 26B showing improved lateral absorption over FIG. 20B), the waste fluid would not easily permeate the absorption member 113 between the atmosphere communicating opening 116 and the fill-up detection sensor 125. As a result, the waste fluid may overflow via the atmosphere communicating opening 116.

Thus, in accordance with the sixth embodiment, by virtually moving the position of the atmosphere communicating opening 116 from the waste fluid introducing space 114 side to the fill-up detection sensor 125 side, the waste fluid can permeate throughout the absorption member 113, so that an improved utilization efficiency of the waste fluid tank can be obtained.

Embodiment 7

Hereafter, the first, not the second, waste fluid tank 100 according to a seventh embodiment of the present invention is described with reference to FIGS. 27 through 30. The first waste fluid tank 100 according to the seventh embodiment includes a container main body 411 and a lid member 412. The lid member 412 has an opening portion 413 via which waste fluid is poured. The container main body 411 and the lid member 412 are sealed by welding, for example. On the inside of the lid member 412, a rib 414 is formed around the opening portion 413, extending toward the inside. Between the rib 414 and the inner walls of the container main body 411, a space 415 for retaining waste fluid is formed.

Figure 29:
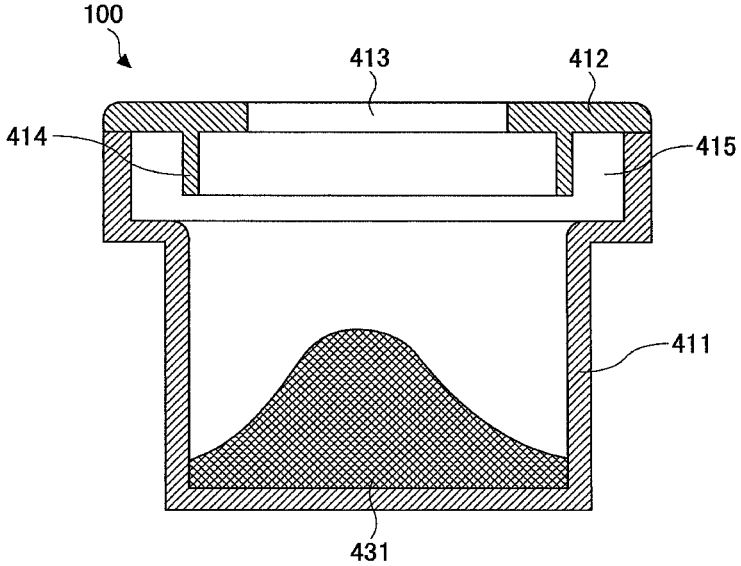
FIG. 29 shows a cross section of the first waste fluid tank illustrating how waste fluid accumulates therein.
Figure 30:
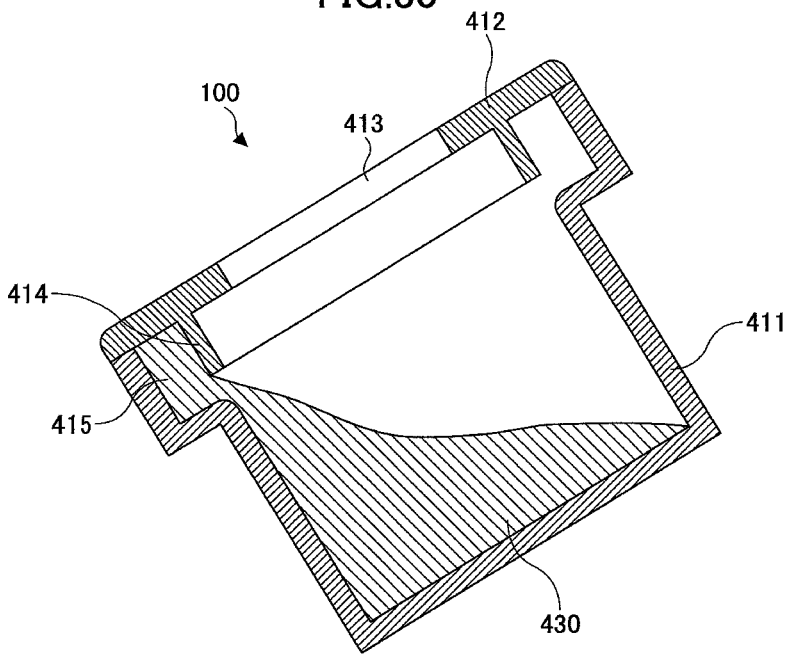
FIG. 30 shows a cross section of the first waste fluid tank when it is tilted.

Referring to FIG. 29, the waste fluid that is poured into the first waste fluid tank 100 accumulates as a deposit 431 when the viscosity of the waste fluid is high. If the first waste fluid tank 100 is tilted before the waste fluid turns into the deposit 431, the waste fluid 430 is retained in the space 415 by the rib 414, as shown in FIG. 30. Thus, the waste fluid is prevented from overflowing via the opening portion 413 of the first waste fluid tank 100 when the image forming apparatus is tilted up to a certain extent during the transport of the image forming apparatus, for example.

Namely, in the case of the open-type waste fluid tank and when the image forming apparatus is easily portable, the waste fluid may flow out of the waste fluid tank via its opening portion when the image forming apparatus is tilted during transport or the like, possibly soiling or contaminating the inside of the apparatus. This may not pose a problem in the case of dye ink or the like because an absorption member can be installed to receive waste droplets, where the waste fluid can permeate the absorption member and be retained therein, without flowing out of the waste fluid container tank even if the image forming apparatus is tilted.

However, when a fast-drying ink is used, the ink dries before it permeates down to the bottom of the absorption member, forming a film of waste fluid with increased viscosity at the top of the absorption member. Such waste fluid film prevents the further absorption of subsequent waste fluid, resulting in the overflowing of the waste fluid that was not absorbed by the absorption member out of the waste fluid tank via the opening portion when the image forming apparatus is tilted.

One conceivable solution to the above problem may be to install the absorption member at a location other than below where waste droplets are discharged. In this configuration, however, the volume of the waste fluid tank decreases.

Figure 27:
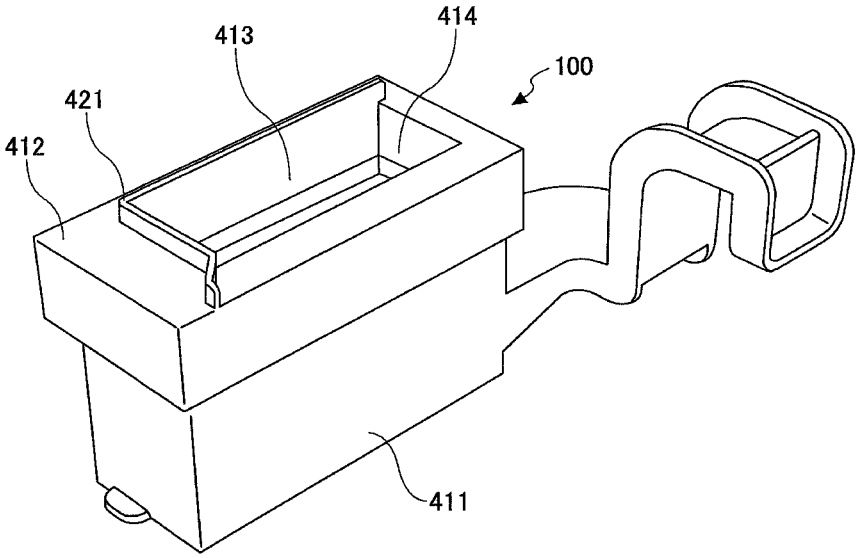
FIG. 27 shows a perspective view of a first waste fluid tank according to another embodiment of the present invention.
Figure 28:
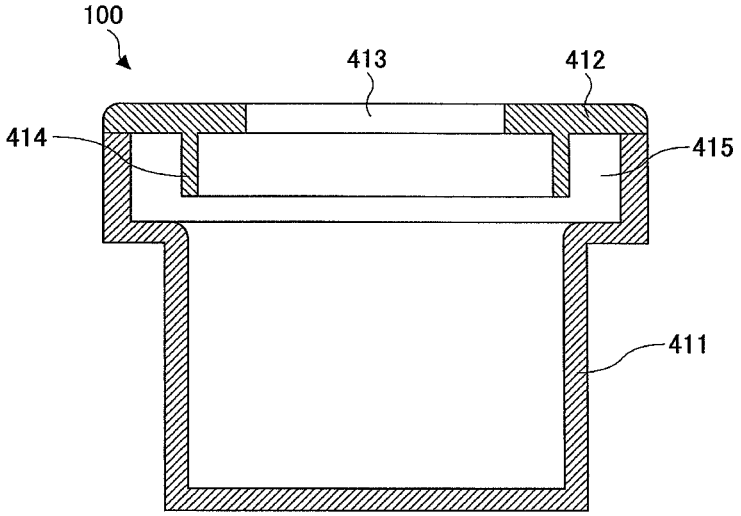
FIG. 28 shows a cross section of a main portion of the first waste fluid tank.

Thus, in accordance with the seventh embodiment described above, the first waste fluid tank 100 is structured to directly receive waste fluid without providing an absorption member. Instead, the rib 414 is provided around the opening portion 413, thus defining the space 415 in which to retain the waste fluid. Further, as shown in FIG. 27, the first waste fluid tank 100 of the present embodiment has another rib 421 on the outside of the lid member 412, extending outwardly around the opening portion 413. The rib 421 reduces the dispersal of the mist of waste fluid during the blank ejection, for example.

Embodiment 8

Figure 31:
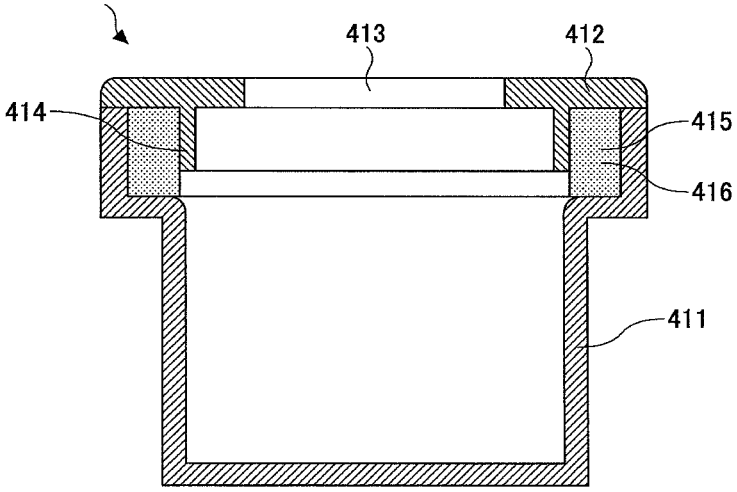
FIG. 31 shows a cross section of the first waste fluid tank according to another embodiment of the present invention.

Hereafter, the first waste fluid tank 100 according to an eighth embodiment of the present invention is described with reference to FIG. 31. In the present embodiment, an absorption member 416 is disposed and retained in the space 415 of the first waste fluid tank 100 according to the seventh embodiment, as shown in FIG. 31. In this way, the waste fluid can be prevented from overflowing through any gap between the container main body 411 and the lid member 412 even when the degree of sealing between the container main body 411 and the lid member 412 is not very high. Thus, the welding step or the like for hermetic sealing can be eliminated and manufacturing cost can be reduced.

Embodiment 9

Figure 32:
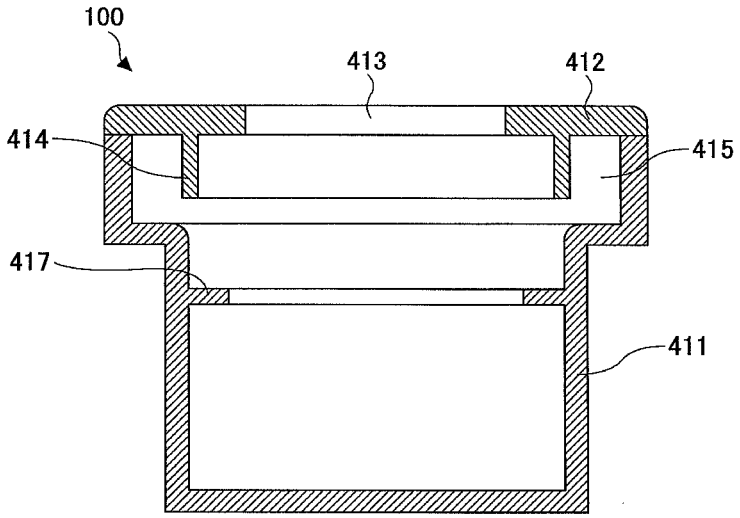
FIG. 32 shows a cross section of the first waste fluid tank according to another embodiment of the present invention.

Hereafter, the first waste fluid tank 100 according to a ninth embodiment of the present invention is described with reference to FIG. 32. The first waste fluid tank 100 according to the present embodiment is similar to that according to the seventh embodiment but includes a rib 417 extending throughout the internal circumference of the space between the top and bottom of the waste-fluid-retaining space in the container main body 411. The rib 417 resists the outflow of waste fluid when the first waste fluid tank 100 is tilted.

The image forming apparatus according to the various embodiments of the present invention includes a facsimile apparatus, a copying apparatus, and a printer/FAX/copier multifunction peripheral, as well as the inkjet printer. The inventive concepts of the present invention may also be applied to image forming apparatuses that eject a fluid other than ink (recording fluid), such as a resist solution or a DNA sample in medicine.

Although this invention has been described in detail with reference to certain embodiments, variations and modifications exist within the scope and spirit of the invention as described and defined in the following claims.

The present application is based on the Japanese Priority Application No. 2008-160735 filed Jun. 19, 2008, the entire contents of which are hereby incorporated by reference.

What is claimed is:

1. A waste fluid tank to store waste ink fluid ejected by a recording head having a nozzle to eject a droplet of ink, comprising:

a main body;

a cap member provided to themain body so as to have an airtight structure;

a waste ink fluid introduction part provided to one end of the main body for detachably connecting to a waste ink ejecting portion, the waste ink fluid introduction part being configured to seal a waste ink ejecting portion side of the main body when the waste ink ejecting portion is detached from the waste ink fluid introduction part;

a communicating opening provided to an upper surface of the other end of the main body so as to communicate an inside and an outside of the waste fluid tank through the cap member; and an absorption member provided in a substantially entire portion of the inside of the waste fluid tank for absorbing the waste ink fluid, said absorption member being formed of a plurality of absorption layers piled one absorption layer on top of another absorption layer, wherein a waste ink fluid introduction space s provided in the waste fluid tank at the one end of the main body where the waste ink fluid is introduced, the absorption member being absent in the waste ink fluid introduction space, wherein the waste ink fluid introduction space has such a length in a longitudinal direction of the waste fluid tank that the absorption member does not contact the waste ink ejecting portion when the waste ink ejecting portion is connected to the waste fluid tank, wherein at least one of the absorption layers is arranged at a bottom of the waste ink fluid introduction space so that the at least one of the absorption layers is located under the waste ink ejecting portion when the waste ink ejecting portion is connected to the waste fluid tank, wherein the absorption member includes a communicating hole space where the absorption layers are absent, said communicating hole space being provided at a part of the absorption member corresponding to the communicating opening formed in the cap member, and said communicating hole space penetrating through the absorption member in a thickness direction of the absorption member so as not to reach the bottom of the waste fluid tank, wherein, the communicating hole space is formed so as to penetrate the at least one of the absorption layers from a surface of a top of the absorption member, and wherein air in the waste ink fluid tank is directly released to the outside of the waste ink fluid tank through the communicating opening and the communicating opening space above the at least one of the absorption layers.

2. The waste fluid tank according to claim 1, wherein a portion of a lowest absorption layer amongst the plurality of absorption layers of the absorption member is disposed directly below the waste ink fluid introduction space.

3. The waste fluid tank according to claim 1, wherein a portion of a lowest absorption layer amongst the plurality of absorption layers of the absorption member is disposed directly below the communicating opening space.

4. The waste fluid tank according to claim 1, wherein a first portion of a lowest absorption layer amongst the plurality of absorption layers of the absorption member is disposed directly below the waste ink fluid introduction space, and a second portion of the lowest absorption layer amongst the plurality of absorption layers of the absorption member is disposed directly below the communicating opening space.

5. The waste fluid tank according to claim 1, wherein the plurality of absorption layers of the absorption member are configured, and disposed, to hamper movement of air between the waste ink fluid introduction space and the communicating opening space.

6. The waste fluid tank according to claim 1, wherein the lowest absorption layer amongst the plurality of absorption layers of the absorption member covers an inner bottom surface of the main body of the waste fluid tank.

7. An image forming apparatus comprising:

a recording head having a nozzle for ejecting a droplet of ink;

a maintenance mechanism including a cap for capping the nozzle of the recording head;

the waste fluid tank according to claim 1, wherein the waste fluid tank is arranged at one side of the maintenance mechanism, and is configured to store waste ink fluid suctioned or ejected from the recording head into the cap.

* * * * *